US006467632B1

(12) United States Patent
Guillot

(10) Patent No.: US 6,467,632 B1
(45) Date of Patent: Oct. 22, 2002

(54) MODEL CAR DISPLAY SHELF UNIT

(76) Inventor: Mark Anthony Guillot, P.O. Box 45212, Dept. 130, Baton Rouge, LA (US) 70895

( * ) Notice: Subject to any disclaimer, the term of this patent is extended or adjusted under 35 U.S.C. 154(b) by 0 days.

(21) Appl. No.: 09/522,643

(22) Filed: Mar. 10, 2000

(51) Int. Cl.[7] ..... A47F 5/00

(52) U.S. Cl. ..... 211/13.1; 211/90.01; 211/90.02; 108/149; 108/152

(58) Field of Search ..... 104/60; 108/149, 108/152; 211/13.1, 26, 90.01, 90.02; 463/62, 63

(56) References Cited

U.S. PATENT DOCUMENTS

| | | | | |
|---|---|---|---|---|
| 3,707,804 | A | * | 1/1973 | Cook |
| 3,860,237 | A | * | 1/1975 | Cooper et al. |
| 4,161,279 | A | * | 7/1979 | Halford ..... 104/60 X |
| 4,479,650 | A | * | 10/1984 | Neuhierl |
| 4,934,522 | A | * | 6/1990 | Nelson |
| 5,560,500 | A | | 10/1996 | Wilcox ..... 211/88 |
| 5,711,435 | A | * | 1/1998 | Morison et al. |
| D391,795 | S | * | 3/1998 | Pellerin |
| D395,562 | S | | 6/1998 | Goodman ..... D6/450 |
| 5,806,689 | A | * | 9/1998 | Mays et al. ..... 211/90.01 X |
| 5,941,176 | A | | 8/1999 | Schultz et al. ..... 108/23 |
| D420,535 | S | * | 2/2000 | Klock |
| D429,919 | S | * | 8/2000 | Kornacki |

* cited by examiner

*Primary Examiner*—Robert W. Gibson, Jr.
(74) *Attorney, Agent, or Firm*—Jones, Walker, Waechter, Poitevent, Carrere & Denegre, L.L.P.

(57) ABSTRACT

A new simple easily mounted, attractive life-like shelf for display of model cars and that can allow for storage of their containers thereon. The invention is comprised of a mounting bracket, straight display shelf, curved display shelf, electrical power receptacle, graphic display board and decals. The device includes at least one straightaway display shelf made from at least one piece of material that hangs on mounting bracket attached to a wall. A sloped horizontal top shelf face surface forms the top surface of a race track, graphic decals and that is the length between end edges of the shelf. A electrical power receptacle located near join of said top shelf face surface and shelf bottom for plugging in display lights, signs and any other miscellaneous electrical device. Lighting can be plugged in as required in electrical power receptacle to provide lighting to only those areas desired by facing upward towards the visual side of the model cars on display. A horizontal flat bottom surface at a right angle from a wall and joined to bottom of top shelf face surface forming an acute angle at join. The length extends between the edges of the shelf that when engaged to a wall form a storage space for model car containers. Model cars can be attached to top shelf face surface with various types wheel chucks to allow for any combination of arranging model cars onto track.

18 Claims, 37 Drawing Sheets

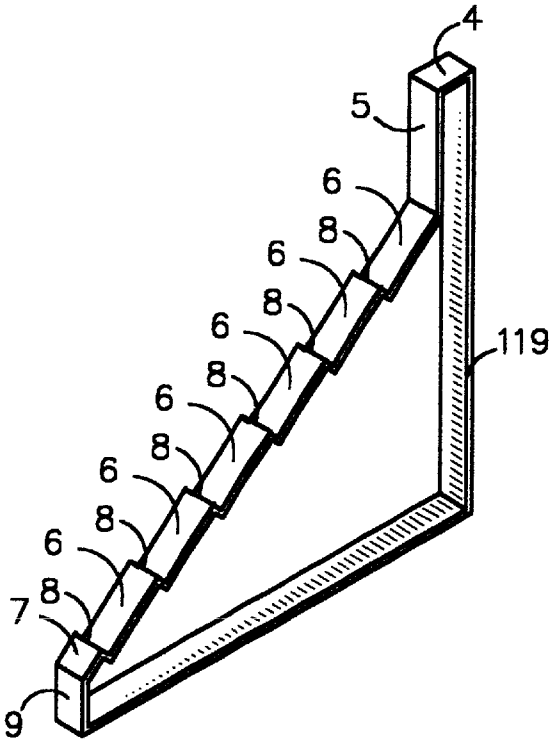
FIGURE 27
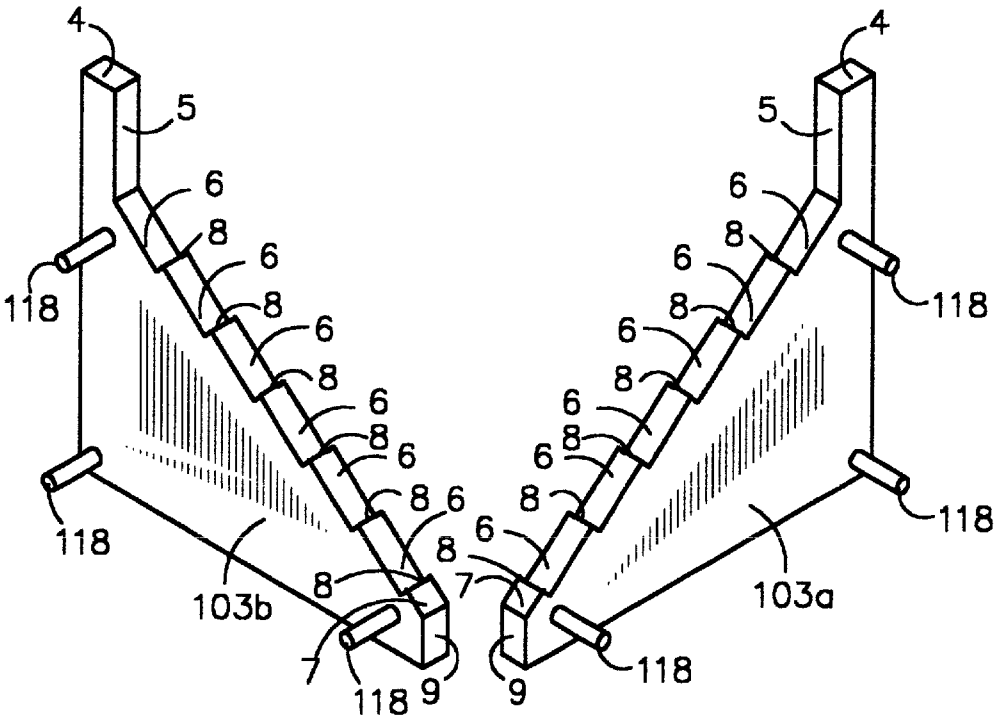
FIGURE 26b
FIGURE 26a

MODEL CAR DISPLAY SHELF UNIT

BACKGROUND OF THE INVENTION

1. Field of Invention

The present invention relates to devices for displaying model cars and associated figurines. It is important for the collector of model cars to keep their original containers that they were purchased in so that the value of the collection is maintained. The present invention allows for storage of said containers so that they do not take up other valuable space and furthermore provide protection of the containers. More specifically, the invention relates to a wall or free standing shelf unit for displaying model cars in various positions. The present invention can also be used by the retailers of model cars for displaying model cars for the sale to consumers.

2. Description of the Prior Art

The uses of displaying models and figurines is known in the prior art. The method used to display the model cars only impersonates the track portion of a racetrack and does not replicate an entire life-like racing or any other automobile related display. The prior art does not allow for a display that would enhance all types of racing backgrounds to create a more realistic life-like display for various and specific types of race tracks and model cars. To mount the shelving to a wall requires a lot of work and makes it impossible to form a complete cylindrical race track in any size room. Furthermore the lighting method used is inadequate, bulky, not adjustable and not easily maintained. The lighting is specified as being located at the top to provide lighting to top surface of track, this causes a shadow on the visual side of display that should be lit from the bottom facing up towards the display. The lighting will also shine in an observer's eyes and furthermore lights do not represent the actual lighting at a race track. Once device is hung on wall, the unattractive mounting hardware, end electrical prongs and wiring is visible from bottom of shelf and allows no storage space for model car containers they were purchased in. Prior art limits the vertical placement of cars on the track in staggering positions to represent an actual race. With the prior art, model cars can only be staggered horizontally making model cars appear to be in single file on any one lane and does not allow for various positions for placement of model cars. Once model cars are in place, the remaining elongated ridges are exposed. The prior art does not have any provisions for custom cutting a shelf to fit any space. Furthermore once their shelves are in place they cannot be removed from wall without disturbing adjacent shelves that have prongs located on the ends for electrically connecting adjacent tracks together. When trying to make a partial display, the shelving dangerously exposes electrically conductive prongs embedded at ends of shelving.

Known prior art devices for displaying model cars include U.S. Pat. No. 5,560,500, issued Oct. 1, 1996, to Jay E. Wilcox, shows a U-shaped track formed into a banked curve mounted onto a wall in a corner of a room. Non-curved straight away tracks may interconnect. A pair of banked curves may be interconnected.

U.S. Pat. No. Des. 395,562, issued Jun. 30, 1998, to Fred W. Goodman, shows a ornamental design for a car display stand.

U.S. Pat. No. 5,941,176, issued Aug. 24, 1999, to Steve P. Schultz and John Matthews, shows a track-like shelf that is mounted onto a wall for display of model cars. Triangular in shape with mounting brackets, top surface is at an acute angle with ridges that allow for two lanes of placing cars to.

Lighting is provided at top, perpendicular to race track top surface. A fencing member is placed adjacent to the top edge of track. Other straight and corner sections of track can be joined together and interlocked. Mounting brackets are triangular in shape and contain a flanged surface for attaching to wall.

Clearly, the above demonstrates a need for a new model car display shelf unit that can easily be mounted and replicate any race track to appear life-like to any type of racing with scenery to match. The amount of detail used to create a model car should also be applied to the shelving that displays them. None of the above referenced prior art devices alone or combined can offer the simplicity, versatile and life-like method of displaying model cars as suggested by the current invention.

SUMMARY OF THE INVENTION

The present invention overcomes the above limitations of the above mentioned inventions by providing a display shelf unit that is as life-like as the model cars it displays and can be mounted at various heights and in various arrangements. In view of the foregoing disadvantages inherent in the known types of devices for displaying model cars presently in the prior art, the present invention also allows a new display shelf unit easily constructed, modified, mounted and removed wherein the same can be utilized for displaying model cars thereon.

One purpose of the present invention is to provide collectors and builders of die-cast and model cars with a new realistic life-like background display shelf unit that not only supports the weight of their collection but enhances it as well. Another purpose of the invention, which will be described subsequently in greater detail, is to provide a new display shelf unit that is easily constructed, mounted and offers a large range of optional devices that can be added or changed as the collection of the model cars change.

To attain this, the invention is comprised of a mounting bracket, shelf, adjustable lights and graphic display board and decals. The device includes, at least one shelf unit triangular in shape and made from one piece of material, a top shelf face surface at an acute angle from bottom surface where they join to form a track, a electrical power receptacle for plugging in display lights that provide lighting of display from bottom facing upwards toward visual side of display and a flat bottom surface extending between edges of the shelf that creates a storage area for storing model car containers.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is a further object of the present invention to provide a new display shelf unit which is of a durable, reliable and attractive construction and easier to install than the prior art.

An even further object of the present invention is to provide a new display shelf unit which is susceptible of a low cost of manufacture with regard to both materials and labor, and which accordingly is then susceptible of low prices of sale to the consuming public, thereby making such display shelf unit economically available to the buying public. The present invention allows the buying public to add to and change it in the future as the industry of collecting model cars changes, furthermore offering a wide variety of products that can be added as the budget or need arises.

Still yet another object of the present invention is to provide a new display shelf unit which provides in the apparatus and methods of the prior art some of the advantages thereof, while simultaneously overcoming all of the disadvantages normally associated therewith.

Still another object of the present invention is to provide a new display shelf unit for displaying model cars with as much detail and realism as the cars that are on display thereon and offer the model car collector a product in which the various types of race track backgrounds can also be collector items.

Still yet another object of the present invention is to provide a new versatile display shelf unit that may be easily hung on a wall mounting bracket and easily removed or be free standing on any horizontal flat surface without any effort.

Even still another object of the invention is to provide a new display shelf unit that is proportionally model to the any race track that it resembles with realistic life-like graphics and the size of cars it is displaying so that cars being displayed thereon look like they are participating in a race.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF DRAWINGS

The invention will be better understood and objects other than those set forth above will become apparent when consideration is given to the following detailed description thereof. Such description makes references to the annexed drawings wherein:

FIG. 26*a* is a perspective view of a shelf right end cover plate with grooves on top surface.

FIG. 26*b* is a perspective view of a shelf left end cover plate with grooves on top surface.

FIG. 27 is a perspective view of a shelf cutting tool with grooves on top surface.

DESCRIPTION OF PREFERRED EMBODIMENT

Figure 1:
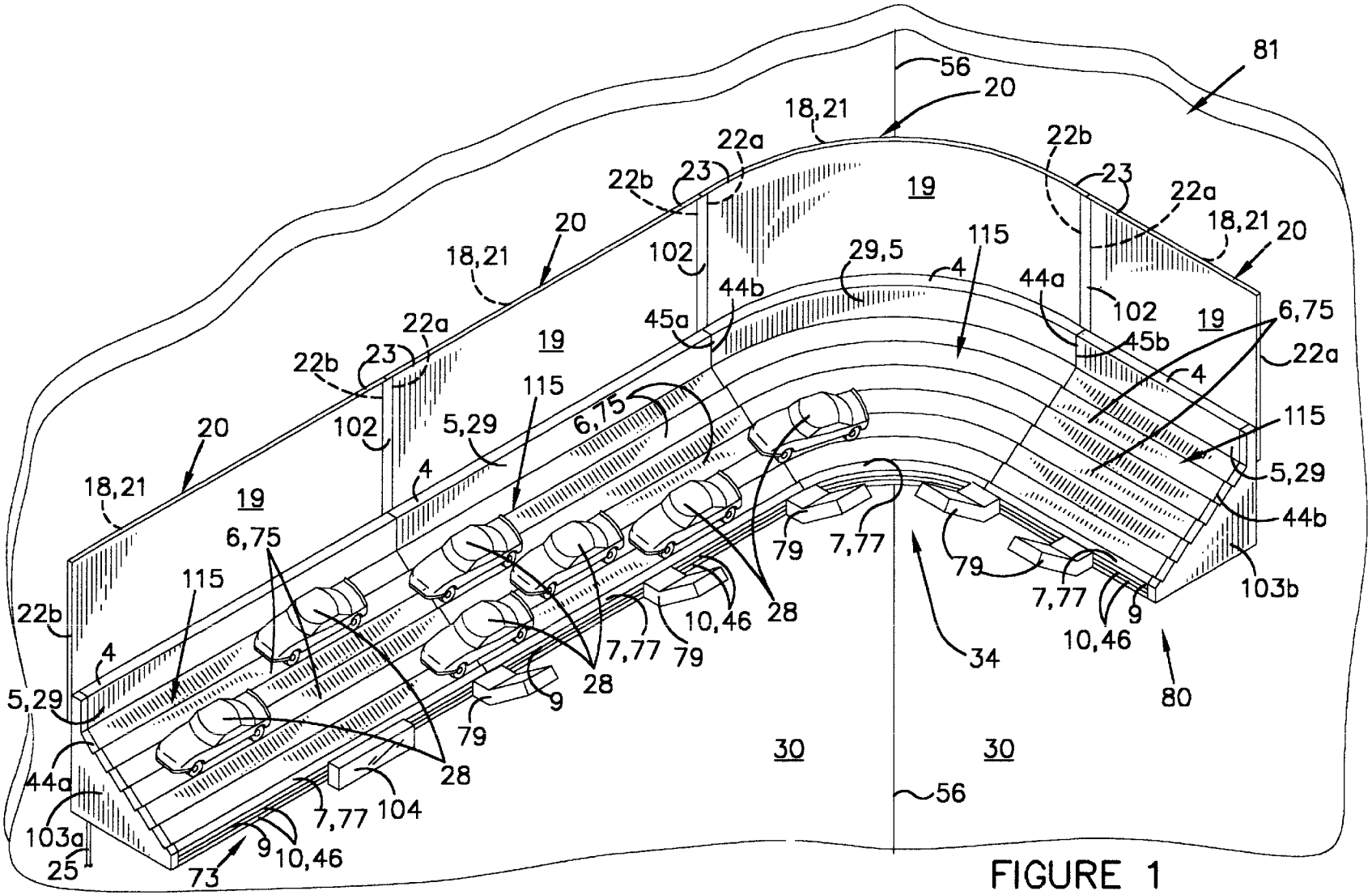
FIG. 1 is a schematic perspective view of three straightaway and one curved shelf unit of a new display shelf according to the present invention.

With reference now to the drawings, and in particular to FIGS. 1 through 47 thereof, a new display shelf unit embodying the principles and concepts of the present invention and generally designated by the reference numeral 1 will be described.

Brief Description of Straightaway Shelf Unit

Figure 4:
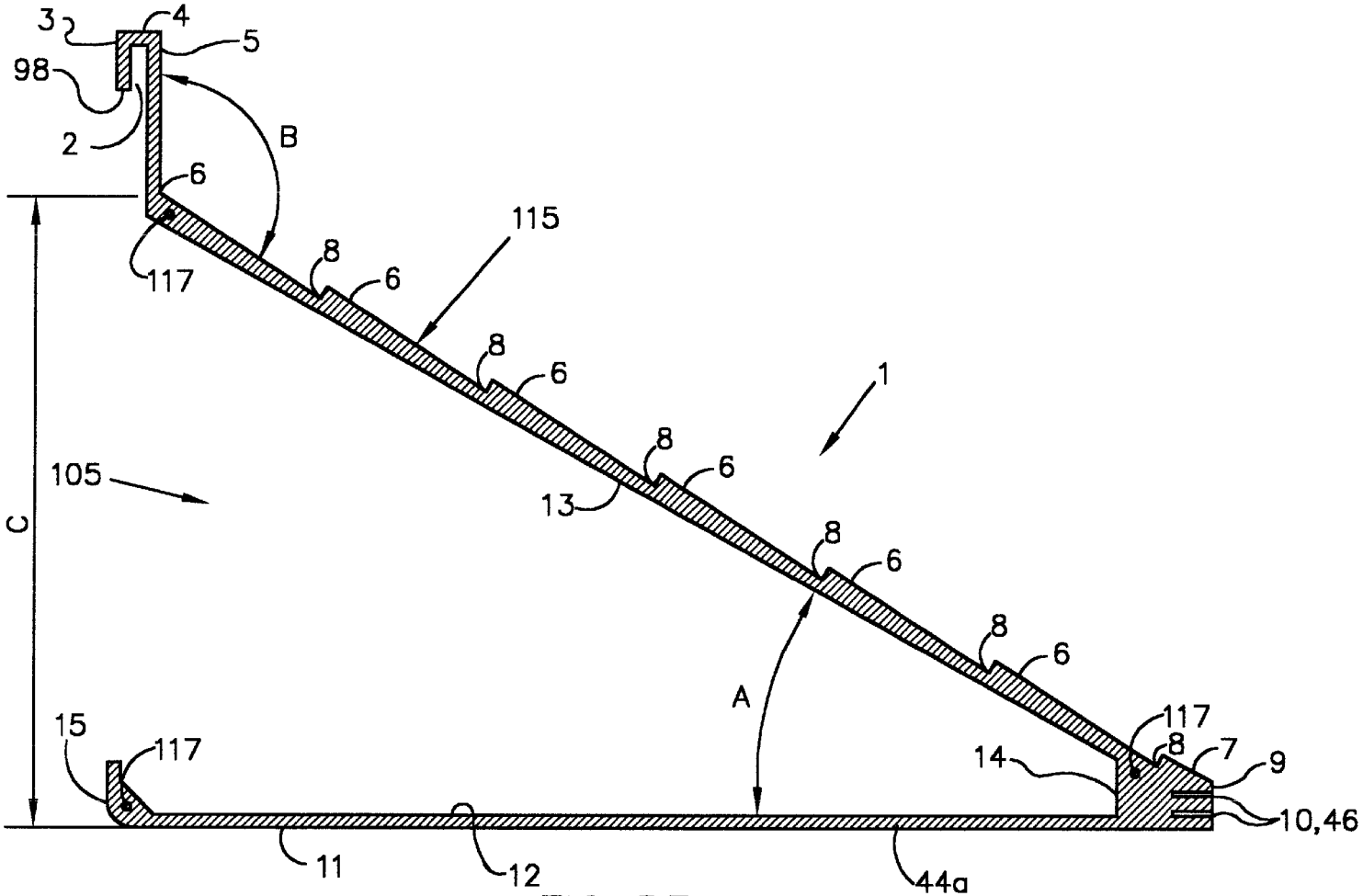
FIG. 4 is a schematic side view of a straightaway shelf unit of present invention without power cord, mounting bracket and graphics board.
Figure 5C:
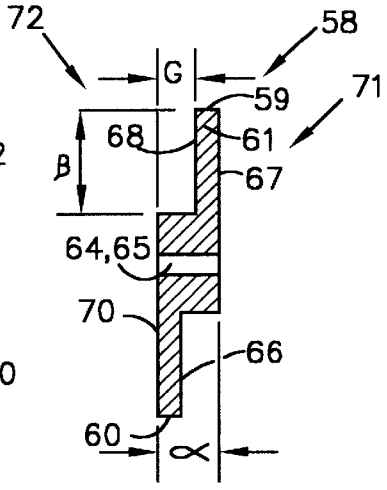
FIG. 5*c* is a section view of a new embodiment of a shelf mounting bracket.
Figure 5B:
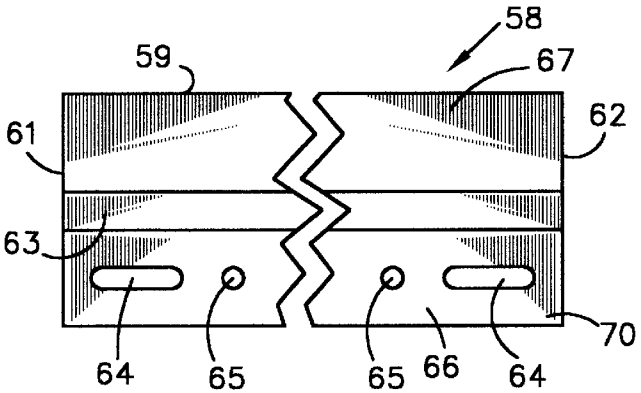
FIG. 5*b* is a front view of mounting bracket.
Figure 5E:
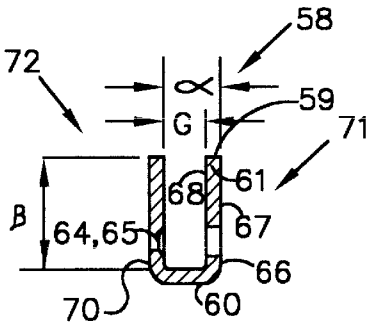
FIG. 5*e* is a section view of a new embodiment of a shelf mounting bracket.
Figure 5A:
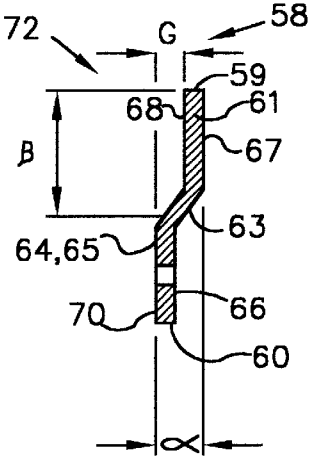
FIG. 5*a* is a section view of mounting bracket.
Figure 5D:
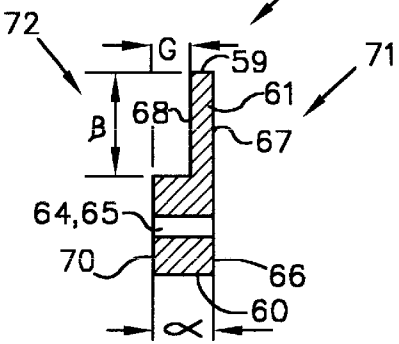
FIG. 5*d* is a section view of a new embodiment of a shelf mounting bracket.
Figure 7B:
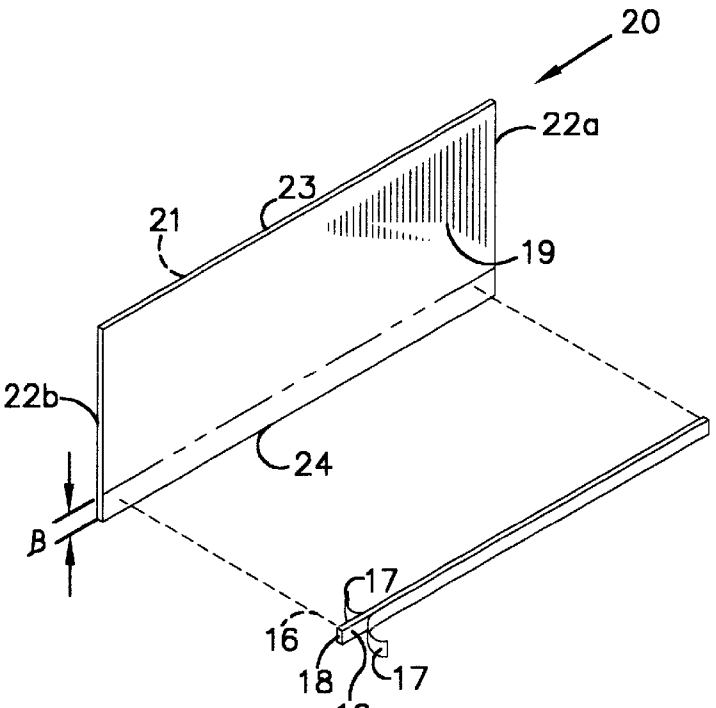
FIG. 7*b* Perspective schematic view of back graphic board for free standing unit or partition wall shelf installation.
Figure 7A:
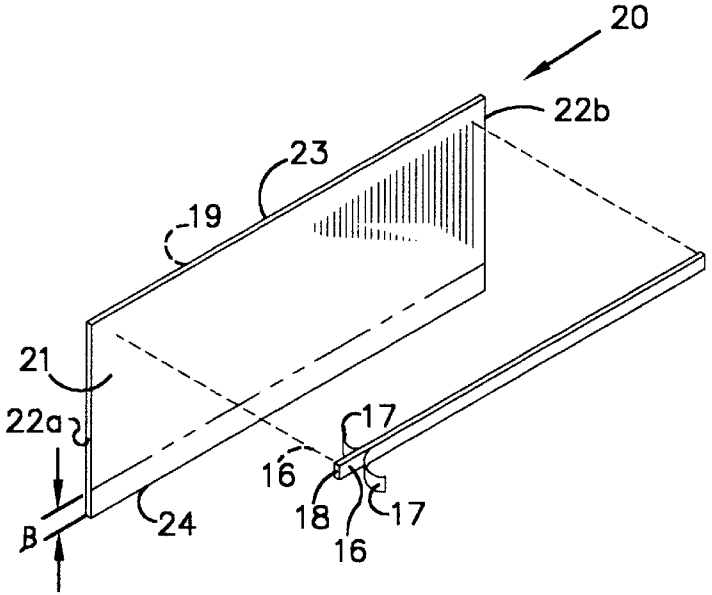
FIG. 7*a* Exploded perspective view of back graphic board for wall mount unit.
Figure 14:
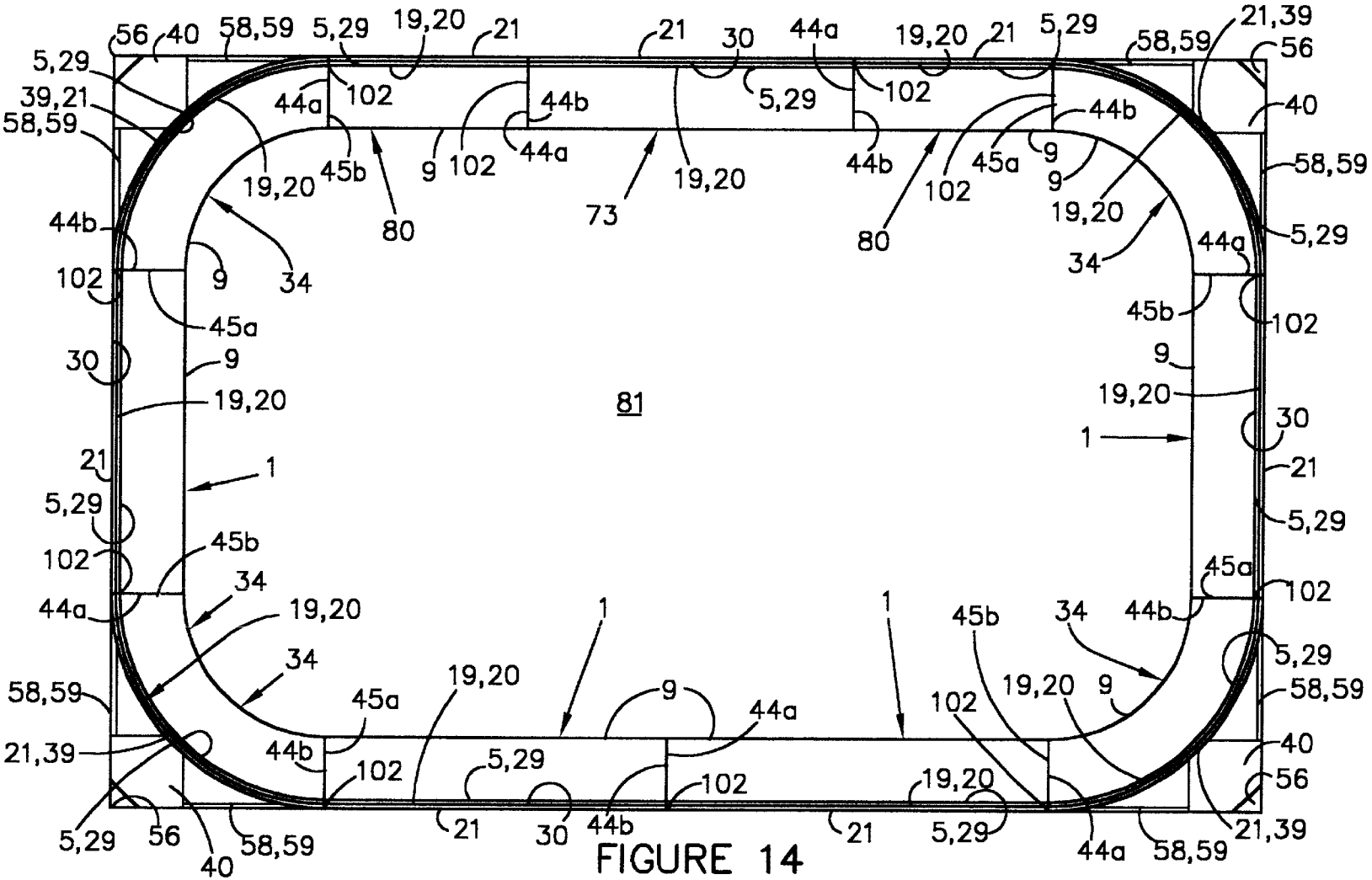
FIG. 14 is a plan view of a typical room with a complete cylindrical track installation using various lengths of straightaway and four curved sections.

As best illustrated in FIG. 4, the display shelf unit 1 generally comprises a top shelf face surface 115 sloped at an obtuse angle represented by the letter B, from mounting channel front surface 5, shelf mounting receptacle 2, front electrical power receptacle surface 9, bottom outer surface 11 at an acute angle represented by the letter A from bottom end of top shelf face surface 115, rear vertical surface 15 of shelf bottom, a pair of edges, left end 44*a,* (right end 44*b* not seen in FIG. 4), graphic board 20 illustrated in FIGS. 7*a* and 7*b* and mounting bracket 58 Illustrated in FIGS. 5*a,* 5*b,* 5*c,* 5*d* and 5*e*. The top shelf face surface 115 has six equally spaced individual sloped surfaces 6 and one shorter sloped surface 7 and when combined they form six equally spaced grooves 8. The material used in forming the shelf can be any lightweight durable plastic or polymer of color to represent any surface of any type racetrack or roadway. As illustrated in FIGS. 27, 33, 42 and 43 the display shelf unit 1 can be cut with a saw to fit any space by sliding it into a cutting guide tool 119, 135, 143 or 144. It is used to guide the saw to make a perpendicular cut or mark as desired along all joining surfaces. A modified display shelf unit 1 that has been cut to fit will be indicated on drawings by the numeral 80 as illustrated in FIGS. 1 and 14. In manufacturing the entire display shelf unit 1 it can be sized proportionally to any model cars sold on the market.

Detail Description of a Storage Shelf

Figure 2:
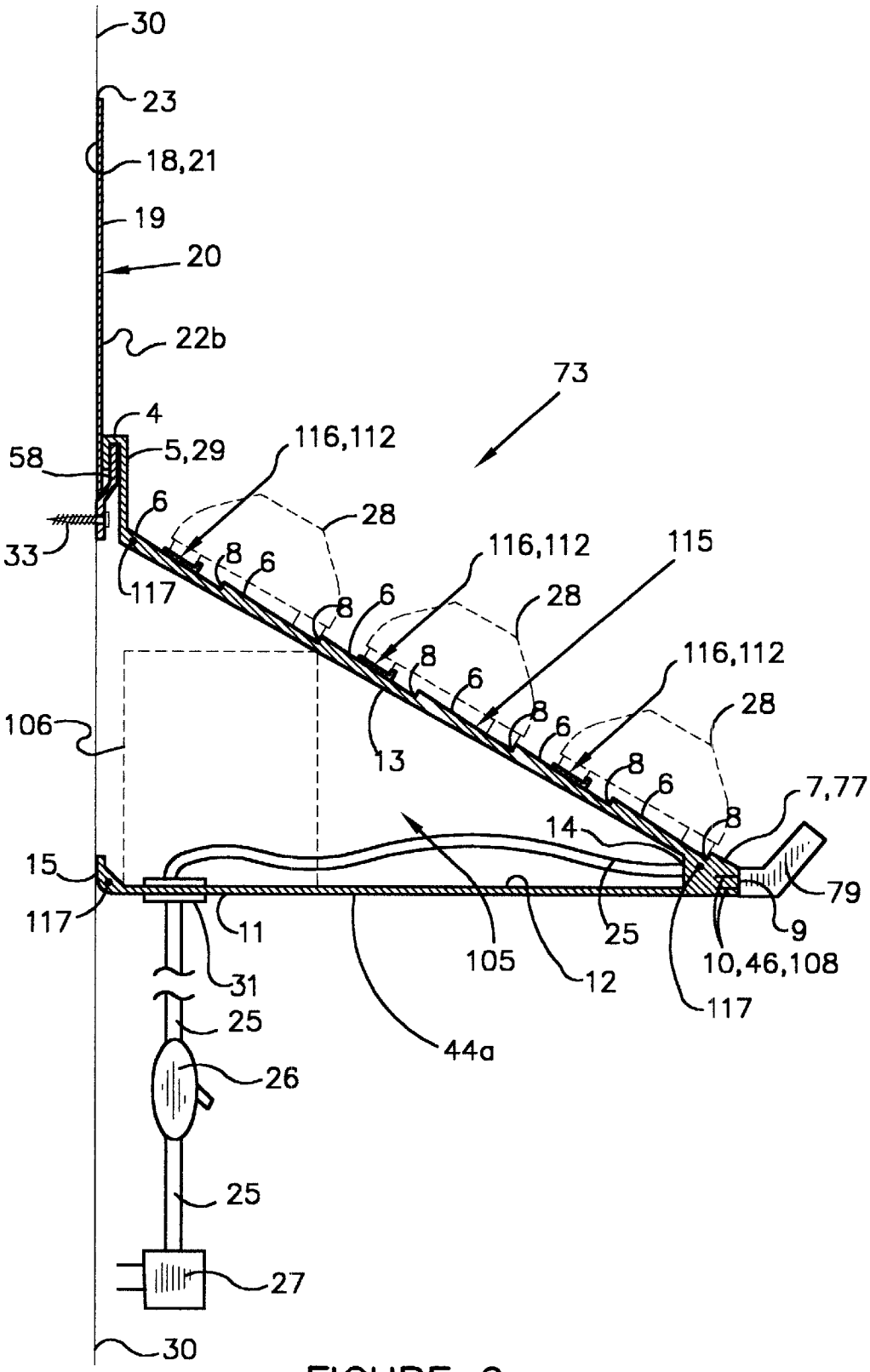
FIG. 2 is a schematic side view of a straightaway shelf unit of present invention with three cars three lane mounting bracket, graphic board and power cord assembly.
Figure 3:
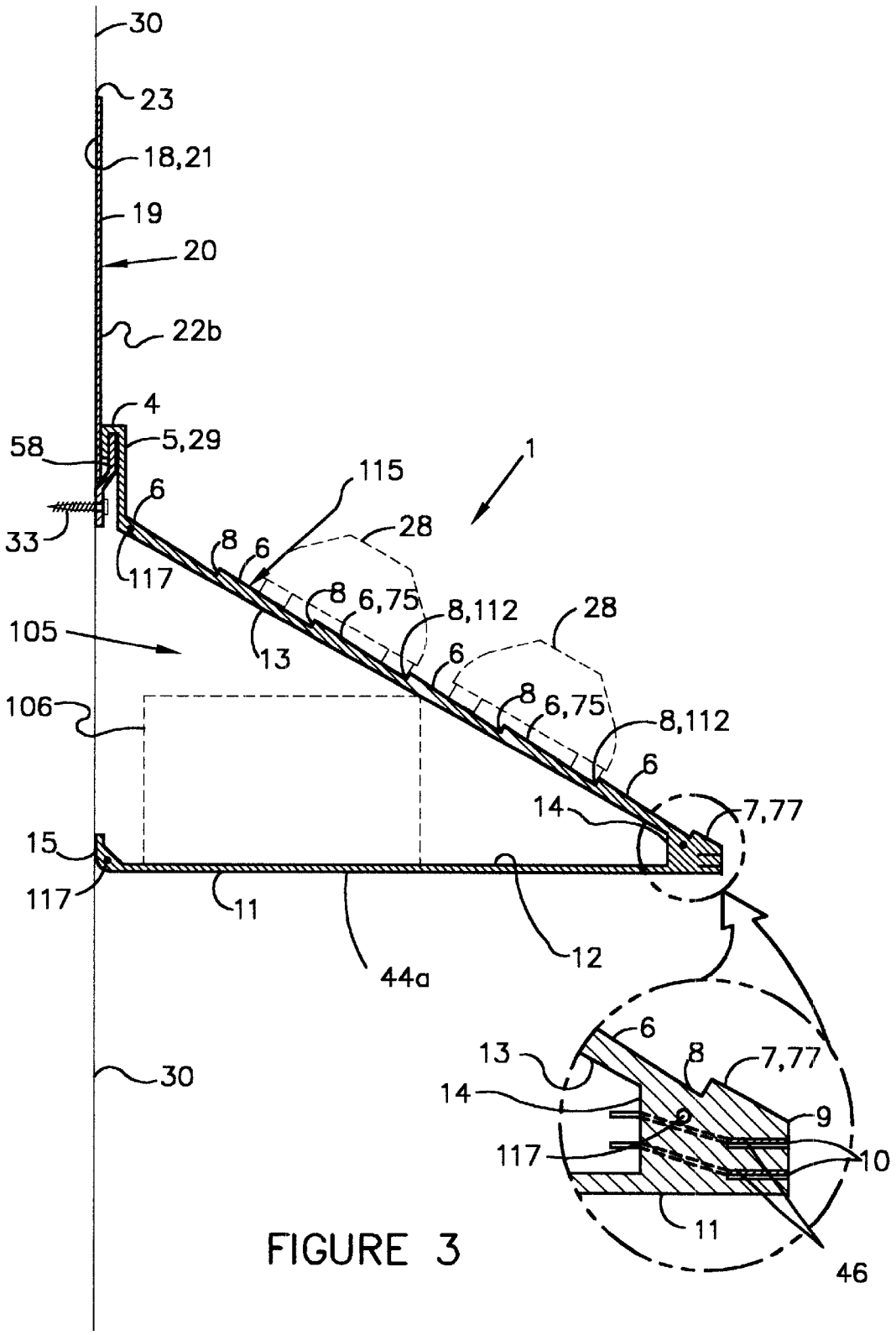
FIG. 3 is a schematic side view of a straightaway shelf unit of present invention with two cars between lanes, mounting bracket, graphic board and an enlarged view of electrical power receptacle.
Figure 15B:
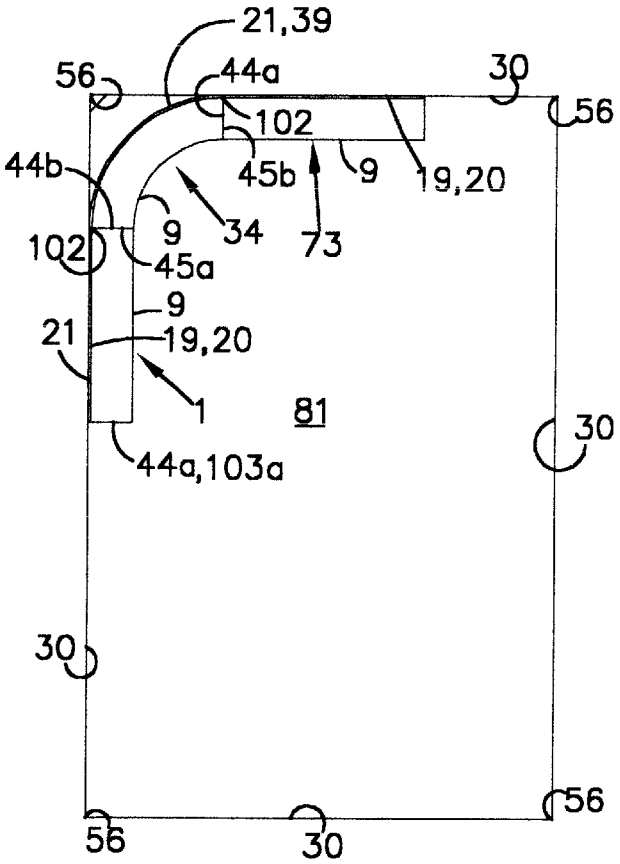
FIG. 15*b* is a plan view of a typical room with a partial display installation.
Figure 15A:
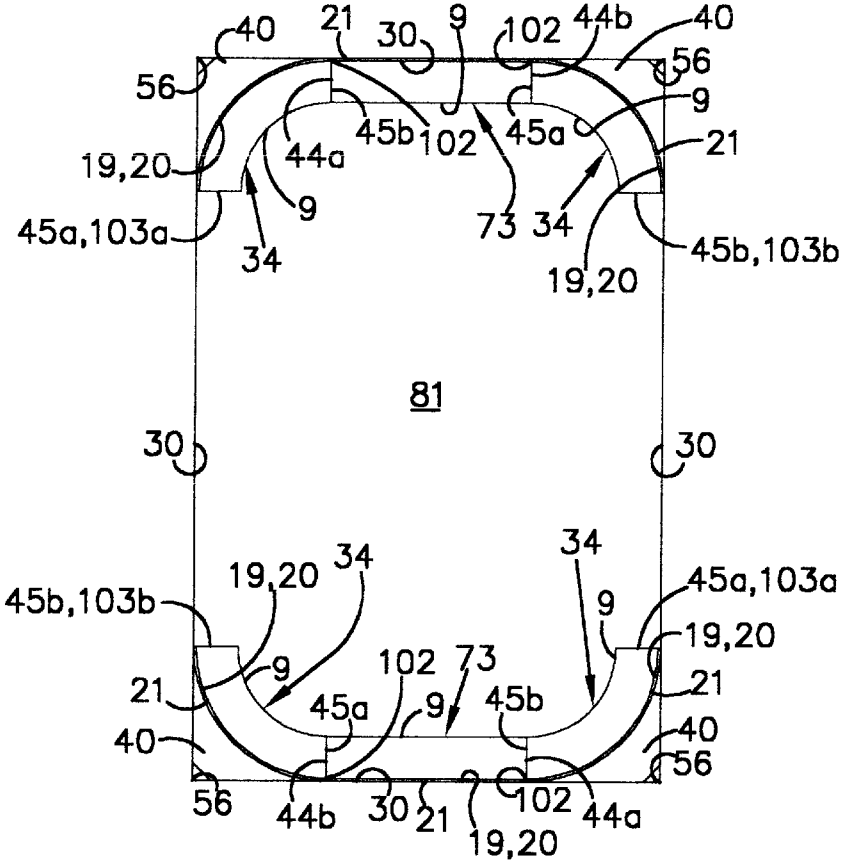
FIG. 15*a* is a plan view of a typical room with a partial display installation.
Figure 15D:
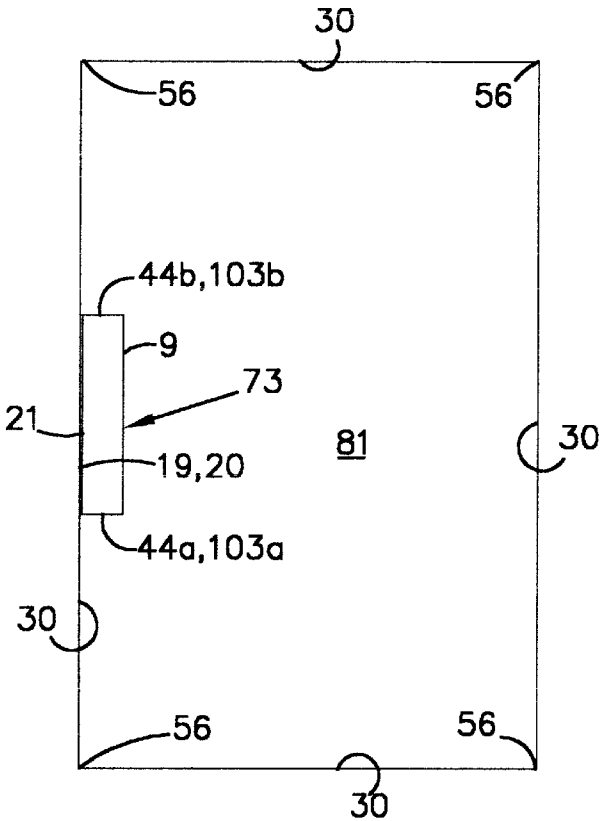
FIG. 15*d* is a plan view of a typical room with a partial display installation.
Figure 15C:
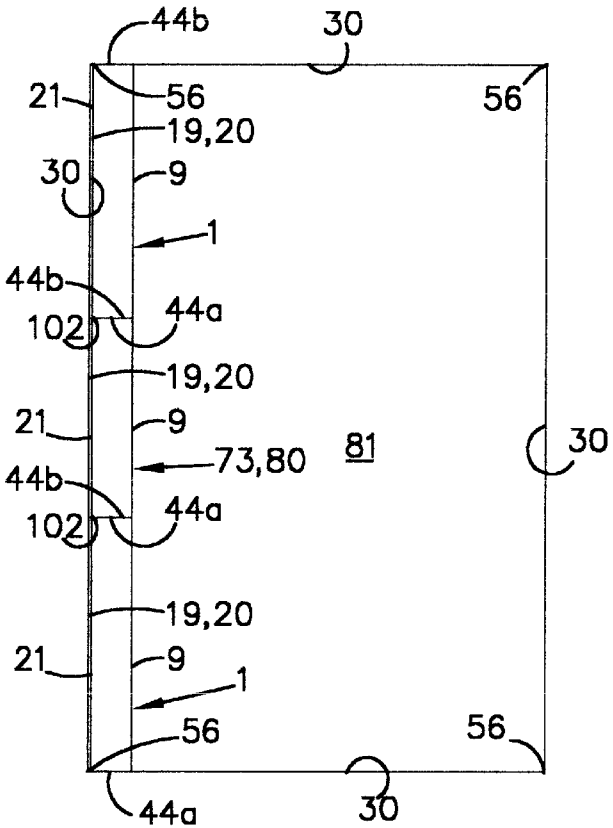
FIG. 15*c* is a plan view of a typical room with a partial display installation.
Figure 22:
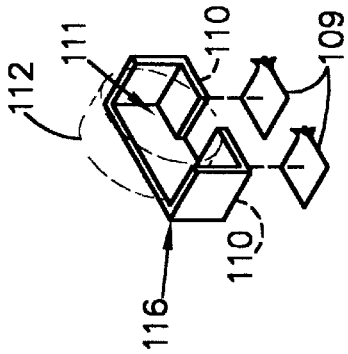
FIG. 22 is a perspective view of an optional model car wheel chuck used to prevent movement of model cars on display when installed in unstable environment.
Figure 18:
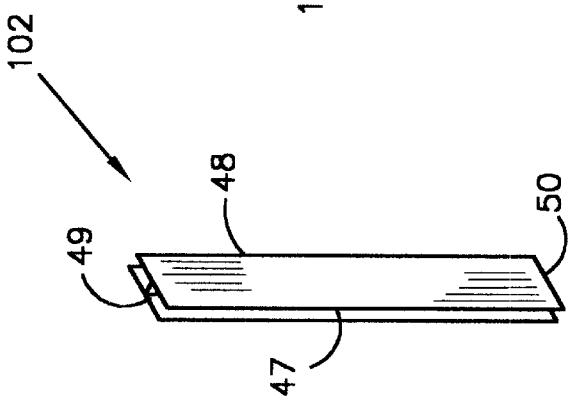
FIG. 18 is a perspective view of clear plastic graphic molding.

In use, the display shelf unit is designed for displaying heavy die-cast model cars and can store their associated containers thereon. It may include several straight and curved display shelves to form different arrangements at any height in any room 81 as illustrated in FIGS. 15*a,* 15*b,* 15*c* & 15*d* or to form a complete cylindrical race track that hangs on the a wall 30 in a room 81 above doorways and windows as illustrated in FIG. 14. In closer detail as illustrated in FIG. 4 each display shelf unit 1 has a top shelf face surface 115 having a mounting channel front surface 5, and combined with top 4, and a shelf lip 3 that projects downwards toward said display shelf unit 1 bottom 11 to conform to a shelf mounting receptacle 2. Front electrical power receptacle surface 9, bottom outer surface 11, bottom inner surface 12, top inner surface 13, vertical surface 15 of shelf bottom, a pair of edges left end 44*a* and right end 44*b*. The top shelf face surface 115 has six equal in length, individually sloped surfaces 6 and when combined form six equally spaced grooves 8. The lower end of each sloped surface 6 meets the bottom edge of each groove 8 which is connected to the top end of the next sloped surface 6 to form grooves 8. As illustrated in FIG. 3 the grooves 8 are used to rest the model car wheels 112 of model cars 28. The model car wheels 112 on the opposite side of model cars 28 will rest on sloped surface 6. When display shelf unit 1 is installed in areas that may be subject to slight movement or vibration a single wheel chuck 116 is installed as illustrated in FIG. 2. Refer to FIG. 22 for single wheel chuck 116 which contains an open space 111 where a model car 28 model car wheel 112 is placed and attached to top of sloped surface 6 by means of double sided tape 109 or can be attached by glue, screws or rivets as located on wheel chuck bottom 110. Other types of wheel chucks are described later in this specification for obtaining optimum placement of cars onto top surface of racetrack when the grooves 8 are omitted in construction of the shelf 1 described above.

Figure 6:
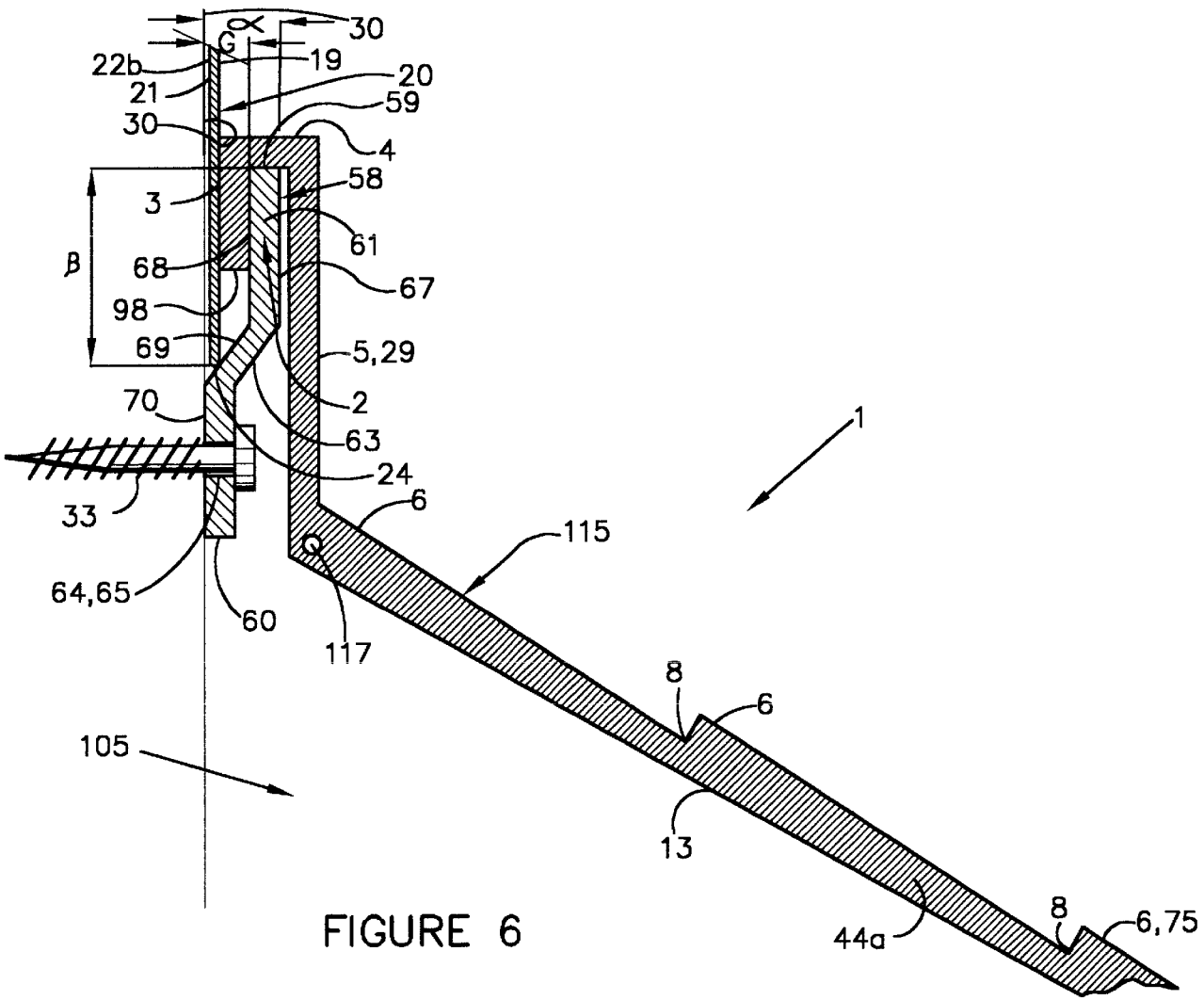
FIG. 6 Partial enlarged top section of shelf, mounting channel, mounting bracket and graphic board.
Figure 8:
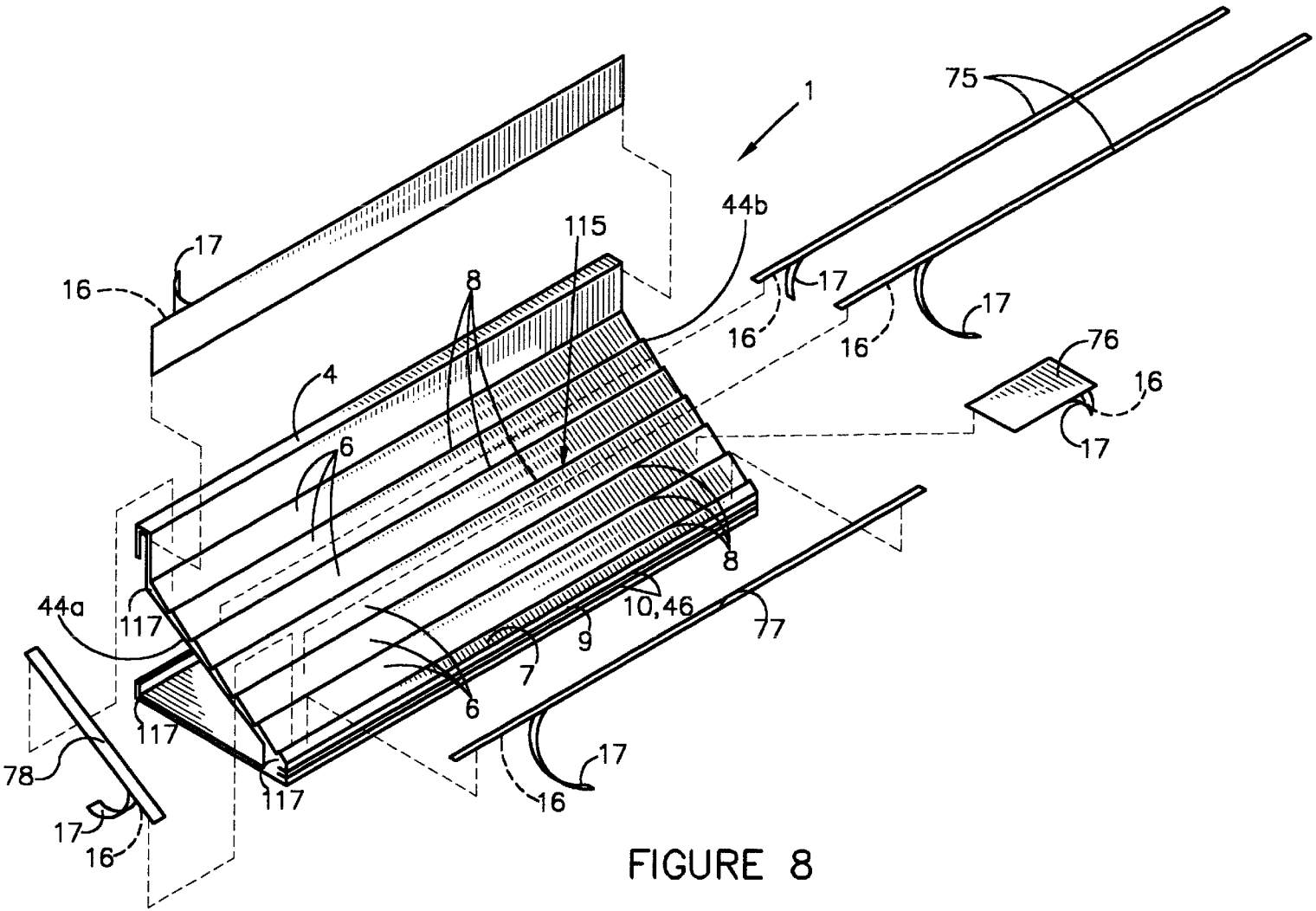
FIG. 8 Exploded perspective view of straightaway shelf with graphics being installed prior to hanging it onto the wall mounting bracket.
Figures 20, 21:
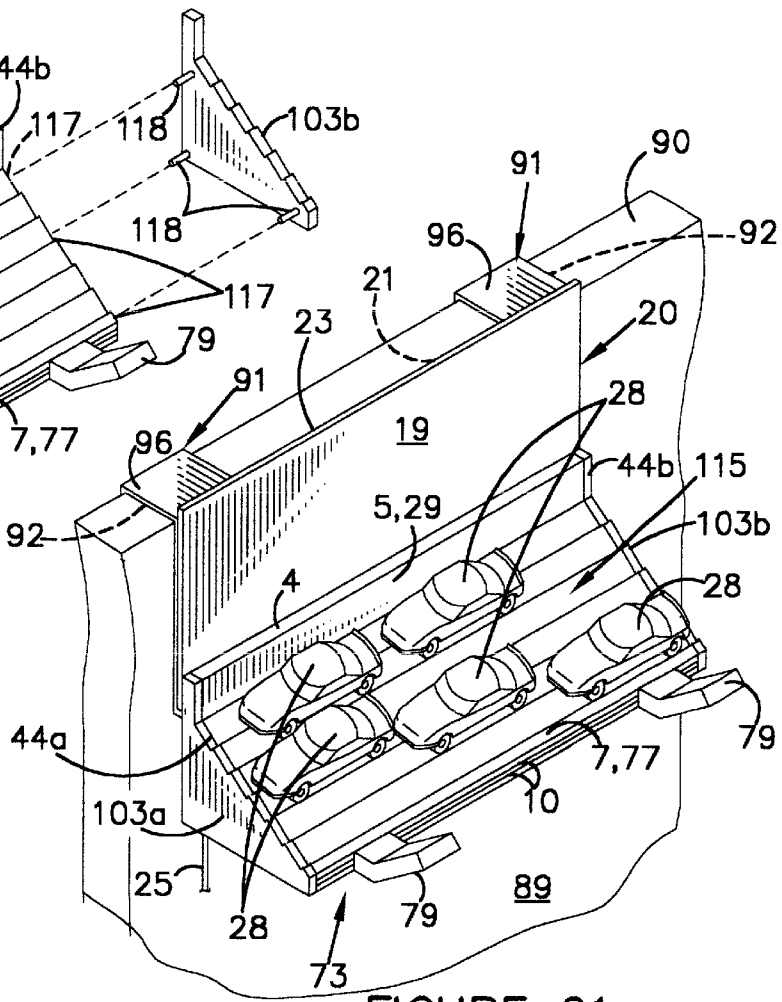
FIG. 20 is a perspective exploded view of second embodiment partition wall mounting bracket, shelf end covers and a display shelf unit.
FIG. 21 is a perspective view of straightaway shelf unit hooked onto a second embodiment wall bracket for hanging shelf on partition walls in a office.

The location of the grooves 8 allows model cars 28 to be equally spaced when placed in every other groove starting from the most upper groove 8. This will allow up to three cars vertically as illustrated in FIG. 2. In addition FIG. 3 illustrates two more model cars 28 can be added behind the three previous described cars on the remaining unused grooves 8 to allow for horizontal staggering arrangements of the model cars 28 as illustrated in FIG. 1. In further detail of display shelf unit 1 refer to FIG. 4 that illustrates a mounting channel front surface 5 that is located at an obtuse angle represented with the letter B adjacent to the top shelf face surface 115. The mounting channel front surface 5 is joined to a mounting channel top surface 4, shelf lip 3 and shelf lip bottom edge 98 and when combined they form a shelf mounting receptacle 2 for resting on top end 59 of a mounting bracket 58 as illustrated in FIG. 6 or lower channel top end 94 of partition wall bracket 91 as illustrated in FIGS. 20 and 21. In even further description of said display shelf unit 1 at least three end cover holes 117 are formed inside thickness of display shelf unit 1 for the purpose of receiving male prongs 118 on shelf end cover plates 103*a* and 103*b* as illustrated in FIG. 20. In FIG. 4 one end cover hole 117 being generally located at top of top shelf face surface 115, lower end of shelf top shelf face surface 115 and rear surface 15. FIG. 26*a* and 26*b* shows end covers 103*a* and 103*b* that can also be designed to friction snap into space 105 omitting end cover holes 117 and male prongs 118. The lower end of top shelf face surface 115 has yet another shorter sloped surface 7 whereas its primary use is for attaching a solid line graphic decal 77 that indicates the outer most inside lane of a racetrack as illustrated in FIG. 8. As shown enlarged and illustrated in FIG. 3, two female electrically connected bus bars 10 are molded inside display shelf unit 1 located at the join of the lower end of top shelf face surface 115 and bottom surface 11 accessible from electrical power receptacle surface 9 and contain open space 46 for receiving male plug 108 from accessory lights as shown illustrated in FIGS. 16 and 17. Illustrated in FIG. 2 is a power cord 25 that can be connected to bus bars 10 within open space 105 at terminal leads extending outwards from the center of inner surface 14. Illustrated in FIG. 2 the power cord 25 is then routed through a hole that contains a rubber grommet 31 and connected to an on/off switch 26 and power transformer or electrical male plug 27. The modified display shelf unit 1 containing power cord 25 will be indicated on drawings by the numeral 73 illustrated in FIGS. 1,28,15*a* thru 15*d,* 19 thru 24. Power cord 25 switch 26, and power plug 27 can be connected to any one display shelf unit 1 or curved display shelf unit 34 installed in any arrangement.

The following item numbers 2,3,4,5,6,7,8,9,10,11,12,13, 14,15,46,98,105,115,117A and B described above are one piece and the length is between left end 44*a* and right end 44*b* and together form the display shelf unit 1. As illustrated in FIGS. 2 and 3, another function the new display shelf unit 1 has is the capability of storing model car 28 containers 106 that the model cars 28 are sold in that normally take up space elsewhere and are needed when trading, moving and maintaining value. Once a display shelf unit 1 is hung, the model car containers 106 can be placed inside shelf open space 105 on bottom inner surface 12.

Description of Curved Shelf Unit

The curved shelf unit 34 is illustrated in FIGS. 9 thru 15*b* and is constructed and functional the same as the straight display shelf unit 1 except the shelf is designed to be installed in a ninety degree corner 56 where two adjacent structural walls 30 meet. As previously mentioned the straight section is comprised of a number of parts that make up a single display shelf unit 1 whereas a curved shelf unit 34 is constructed and functional the same as a straightaway display shelf unit 1 except it is curved, whereas the curved shelf unit is labeled 34. The shelf mounting receptacle 2 of the straight away shelf 1 equals left side curved shelf mounting receptacle 53 and curved shelf right side mounting receptacle 52 of the curved shelf unit 34, The rear surface 3 equals left side 42*b* and right side 42*a*. In further detail of curved shelf unit 34, it also contains flat top surface 40, a forty five degree open corner 41, cylindrical end cover holes 117, shelf left end 45*a,* right end 45*b* and a curved groove 39 for receiving graphic board 20.

Description of Graphic Decals

In addition to the parts previously mentioned the display shelf unit 1 has several self adhesive graphic decals that can be applied to enhance the appearance of the race track as illustrated in FIG. 8 and not to be limited to only the graphics and colors described herein. A top track wall graphic decal 29 is placed on front surface 5 to illustrate corporate track sponsor logos, tire and car paint marks from a crash and wall that separates the track from the spectators. A second pair of dashed line graphic decals 75 can be equally placed on top of shelf face surface 115 to divide and illustrate the track as being three lanes wide. A third finish line graphic decal 78 can be added across the width of top shelf face surface 115, generally located beneath flagman displayed on the graphic board 20. A fourth miscellaneous graphic decal 76 can be added to any place on top shelf face surface 115 to illustrate tire skid marks from a crash on the track. A solid line graphic decal 77 is placed on the top of the bottom short sloped surface 7 to illustrate the innermost lane of the racetrack. The following item numbers 29,75 & 77 described above are the length of top shelf face surface 115 between left end 44*a* and right end 44*b* and have a self adhesive surface 16 with adhesive protective strip 17.

Description of Graphic Board

Figure 12:
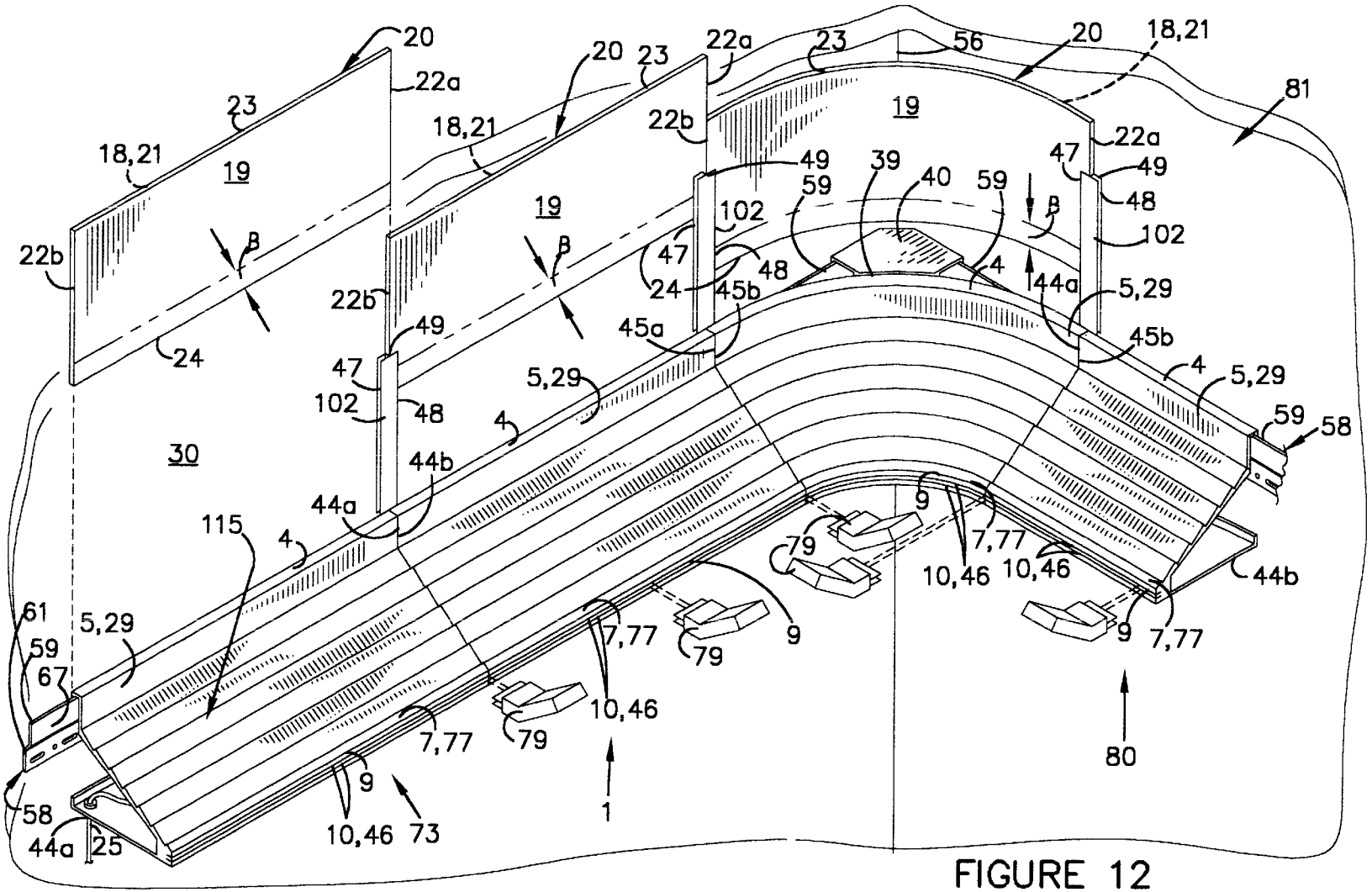
FIG. 12 Exploded perspective view with three straightaway shelves and one curved shelf unit installed an c board and lights being installed.
Figure 13:
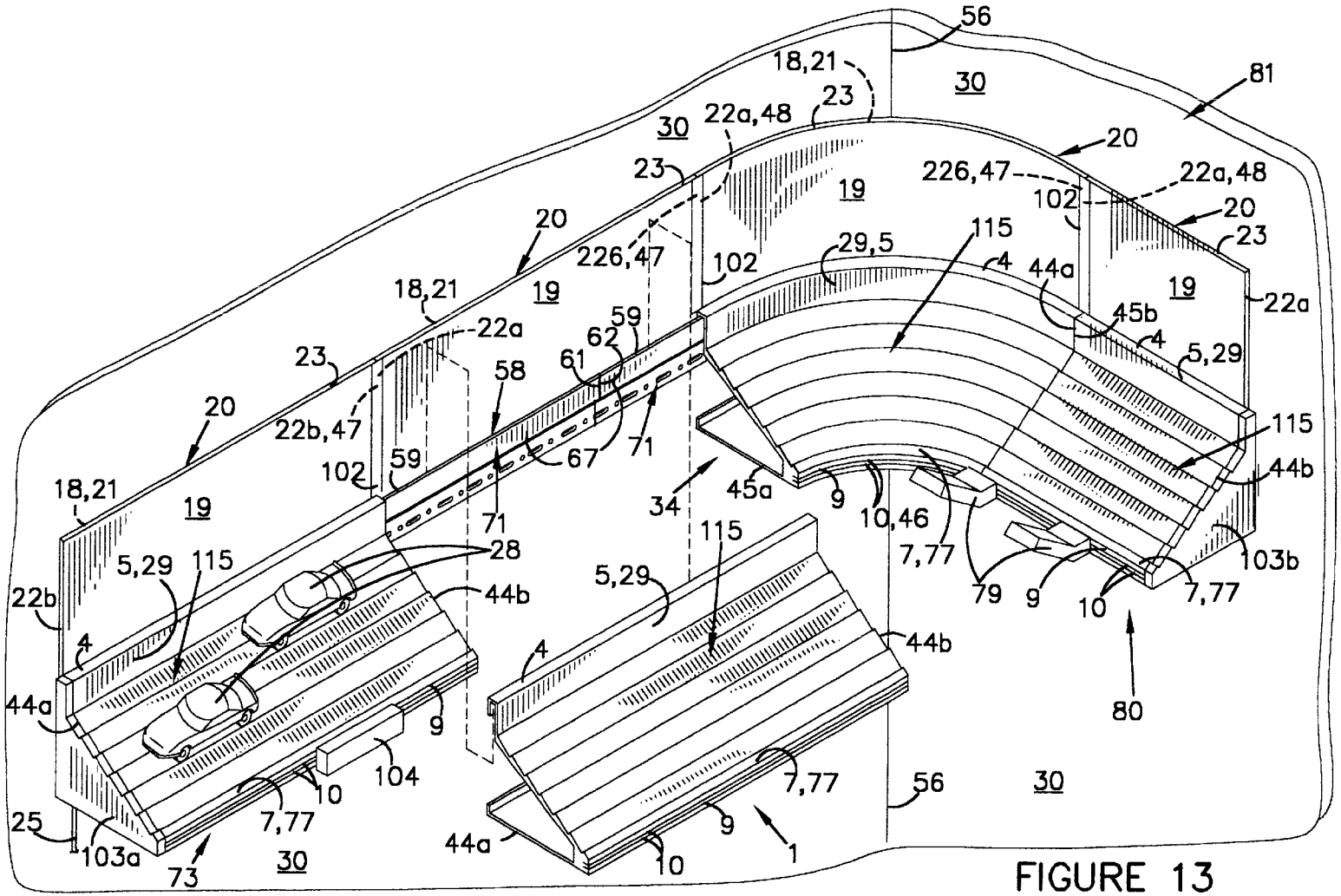
FIG. 13 Perspective view of three straightaway and one curved shelf unit completely installed with all accessories and model cars installed.
Figure 29:
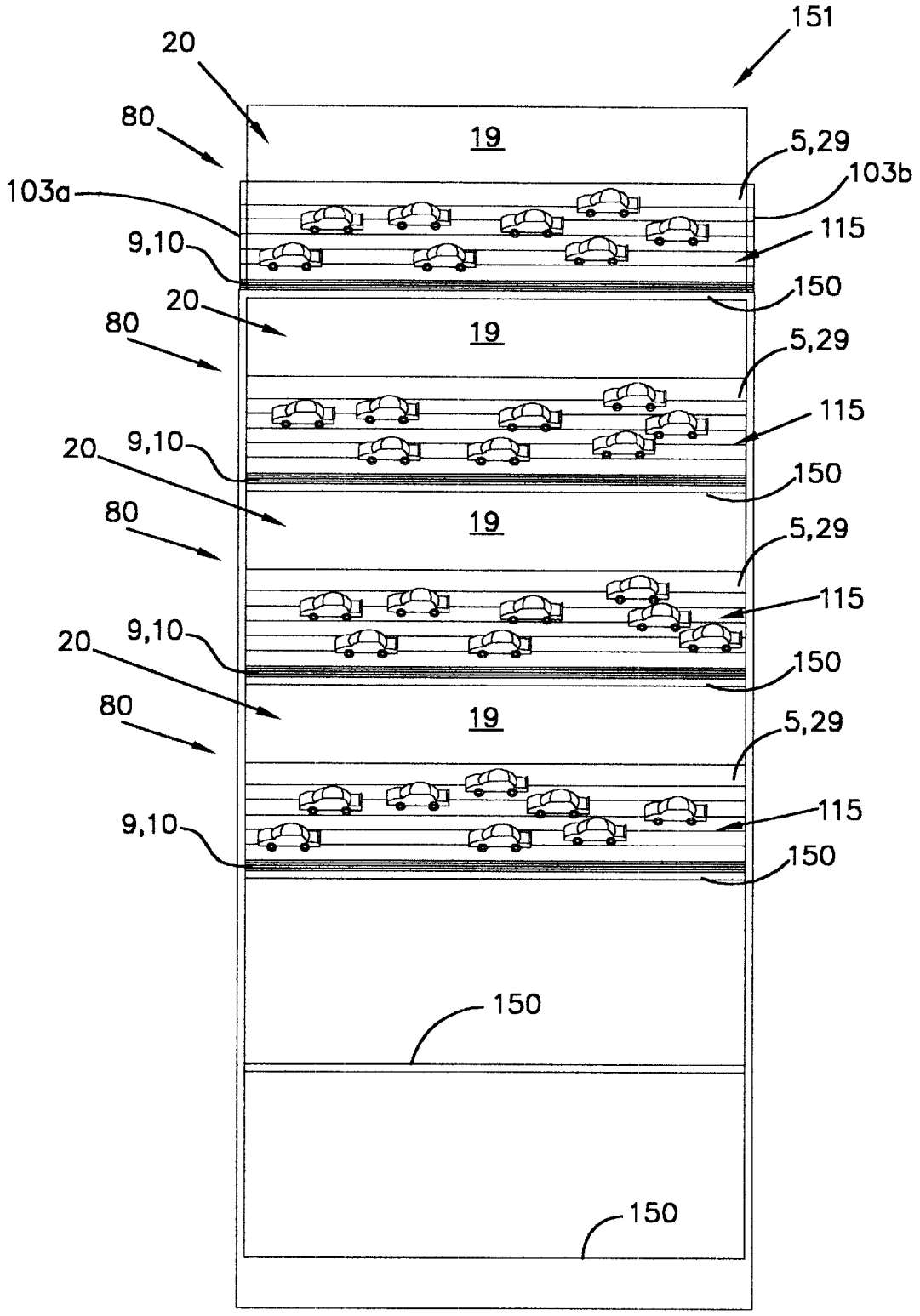
FIG. 29 is a elevation view of multiple shelf units cut to fit and getting inside on a standard adjustable book shelf.

The main piece of graphics is the graphic board 20. It is a separate piece from the display shelf unit 1 and mounting bracket 58 and when combined create the life-like display mentioned. Illustrated in FIG. 7*a* and 7*b* the graphic board 20 is comprised of a left end 22*b,* right end 22*a,* top end 23, bottom end 24, rear blank surface 21, lower section indicated by the BETA symbol that is reserved for insertion behind mounting bracket 58 and rear shelf mounting lip 3 as illustrated in FIGS. 2,3,6 and 12. The most important part is the graphic surface 19 of the board 20 that contains an actual photographic, computer generated or artist generated background containing any scenery that would be seen at an actual racetrack or road side. Some of the items you would see at a race track are fence, wall audience, grandstands, press box, flagman, corporate sponsor signs, clouds, buildings, sky and etc. As illustrated in FIG. 6 the thickness of the graphic board 20 is slightly less than the distance of the space between the shelf mounting lip 3 and the structural wall 30. The graphic board 20 is durable and flexible such that when installed behind a curved shelf unit 34, the graphic board 20 will conform to the shape of the track and is supported upright on its own as illustrated in FIGS. 12 and 13. Prior to installing the graphic board 20 a double sided adhesive tape 18 with adhesive surface 16 is placed adjacent to top surface 23 on blank surface 21 as illustrated in FIG. 7*a*. Once the graphic board 20 is in place, the clear plastic channel 102 represented in FIG. 18 with a first end 49 and a second end 50 is installed by sliding its first channel 47 and second channel 48 on either joining ends 22*a* and 22*b* of graphic board 20 if other units will be installed as illustrated in FIGS. 12 and 13. The remaining adhesive protective strip 17 is removed on graphic board 20 and the top surface is firmly pressed to stick to the structural wall 30. A race fan can also collect the different race track graphic boards 20 available and have multiple displays as illustrated in FIG. 29.

Description of Mounting Brackets

Figure 9:
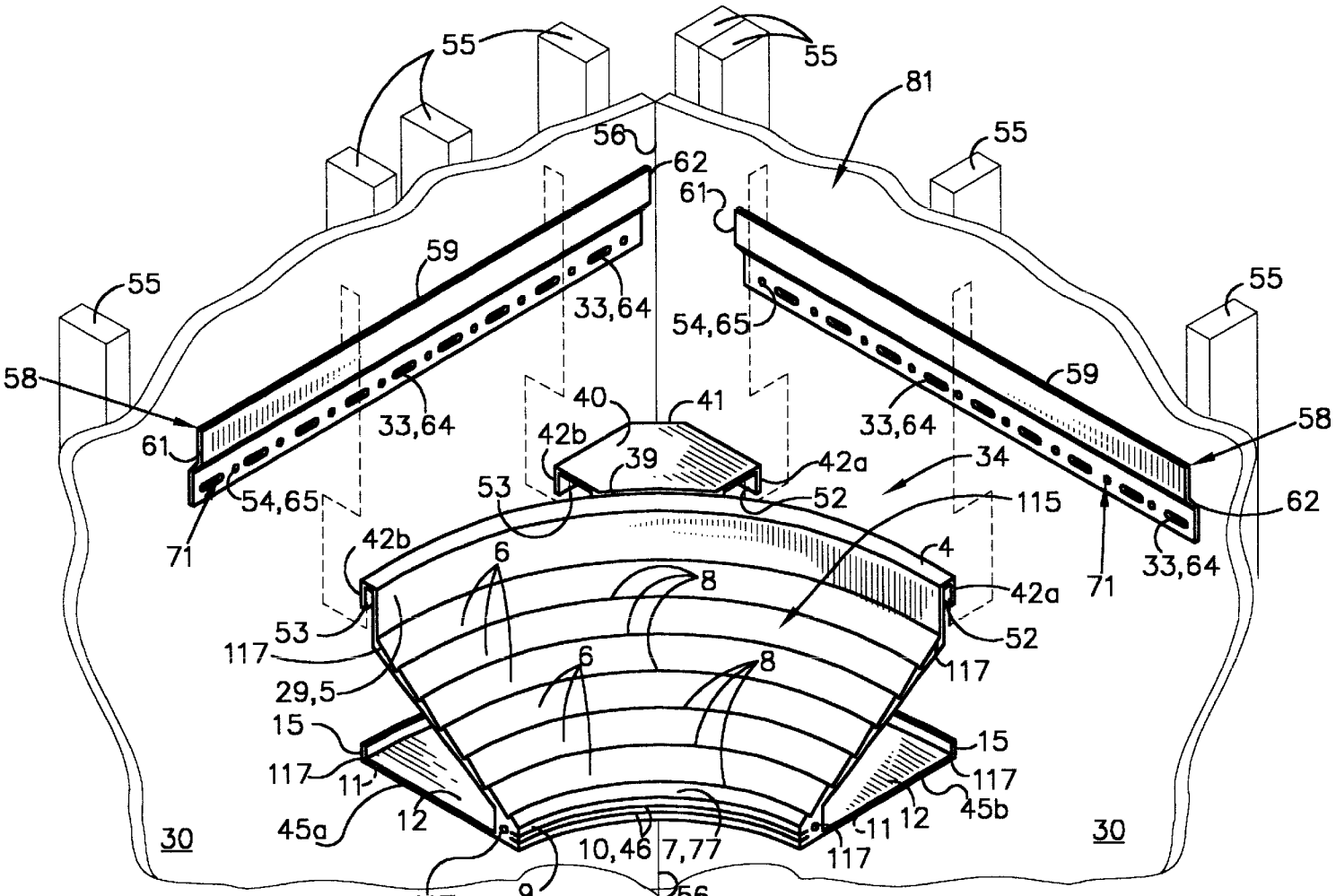
FIG. 9 Exploded perspective view of curved shelf unit with graphics installed being hung on to wall mounting bracket.
Figure 45:
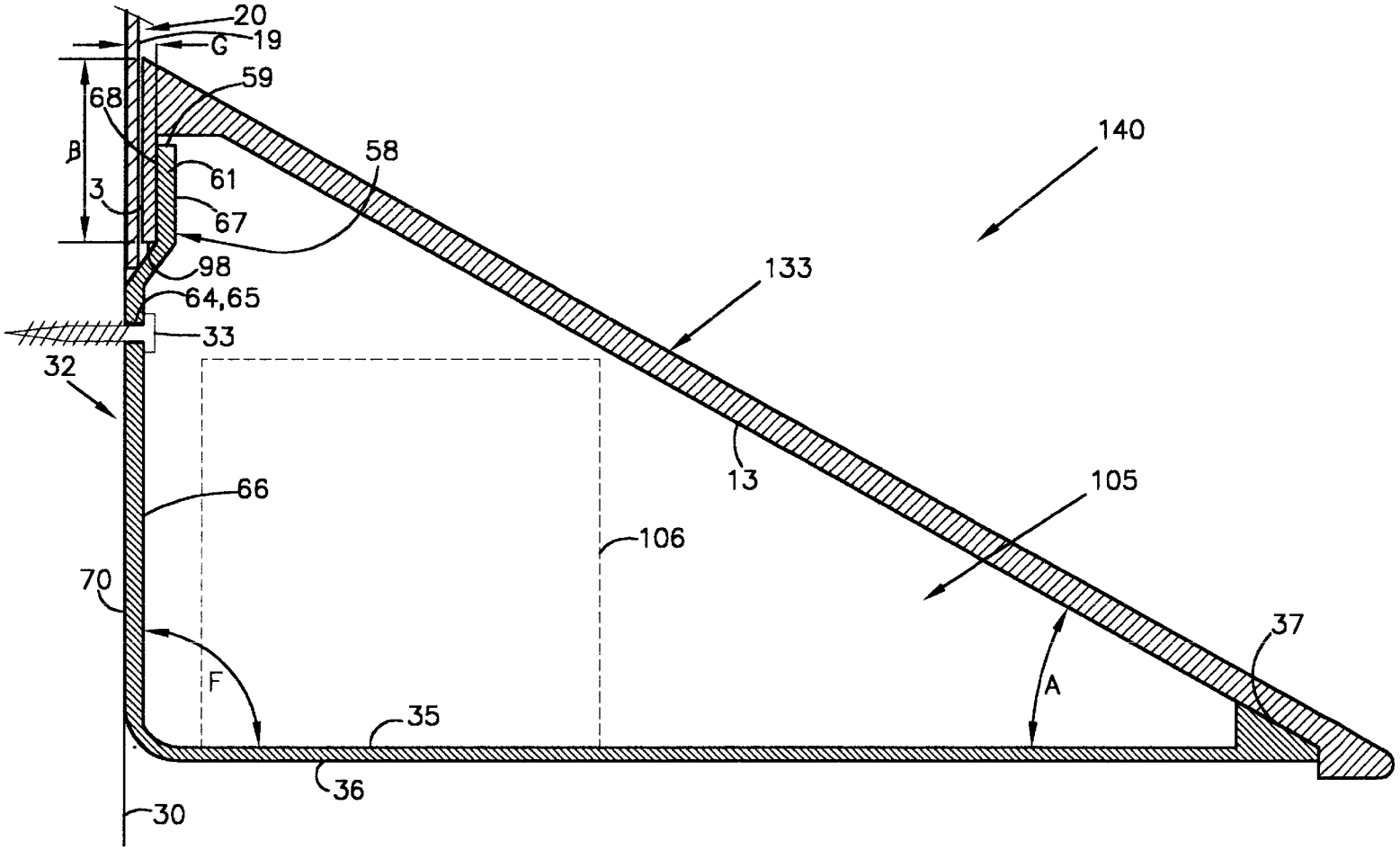
FIG. 45 is a schematic view of mounting bracket with bottom storage shelf with shelf.

Each display shelf unit 1 can incorporate the use of a perforated mounting bracket 58 when being attached to a wall 30 illustrated in FIGS. 5*a* and 5*b*. Various other types and shapes of mounting brackets are illustrated in FIGS. 5*c,* 5*d* and 5*e* and are functionally the same as mounting bracket 58 described in FIG. 5*a* and 5*b* herein. The mounting bracket 58 has a front 71, rear 72, top end 59, bottom end 60, left end 61 and right end 62. The front 71 has a top surface 67, bottom surface 66 and sloped surface 63. The rear 72 has a top surface 68, bottom surface 70 and sloped surface 69. As illustrated in FIG. 9 the length of the mounting bracket 58 can be cut as needed to reach at least two main wall 30 structural members 55 referred to in FIG. 6. The thickness of top end 59 is slightly less than the width of the shelf mounting receptacle 2 to allow the display shelf unit 1 to slide horizontally on mounting bracket 58 without binding. The distance indicated with the ALPHA symbol on FIGS. 5*a* thru 6, between front 71 top surface 67 and the rear 72 bottom surface 70 is slightly larger than the combined thickness of display shelf unit 1 shelf mounting lip edge 98 plus the thickness of the graphic board 20. When the mounting bracket 58 is mounted to a structural wall 30 it creates a mounting bracket receptacle represented with the letter G an its main purpose is for accepting the thickness of the graphic board 20, display shelf unit mounting lip 3 and or as described later in this specification a shelf brace lip 113. The entire length of the mounting bracket 58 bottom surfaces 66 and 70 is perforated with equally spaced mounting screw slots 64 and screw holes 65 to allow for attachment to any structural wall member 55 with screw 33. If a structural member is not available behind the mounting bracket 58 an expandable screw 54 is used in hollow areas as illustrated in FIG. 9. Refer to FIG. 45 for yet another embodiment of a mounting bracket with bottom shelf 32 and has all the same parts and functional as mounting bracket 58 except bottom end 60, bracket front bottom surface 66 rear bottom surface 70 further extends downward joining the bracket bottom surface 35 and an outer surface 36 at a right angle represented by the letter F and further containing an outer front surface 37 at the same acute angle extending upwards to match shelf unit 140 top inner surface 13.

Other Ways to Mount Shelves

Another embodiment of mounting hardware is a pair of partition wall mounting brackets 91 illustrated in FIGS. 20 and 21 to be used when hanging display shelf unit 1 to a partition wall 89. The partition wall mounting brackets 91 has a top surface 96, front surface 99, partition wall first receptacle 92, rear inner surface 95, shelf mounting second receptacle 93, bottom surface 97 and lower channel top end 94. The partition wall first receptacle 92 of partition wall mounting bracket 91 is placed on top surface 90 of partition wall 89 and the second shelf mounting receptacle 93 is used for receiving graphic board 20, display shelf unit mounting lip 3 and or mounting brace lip 113.

Figure 25:
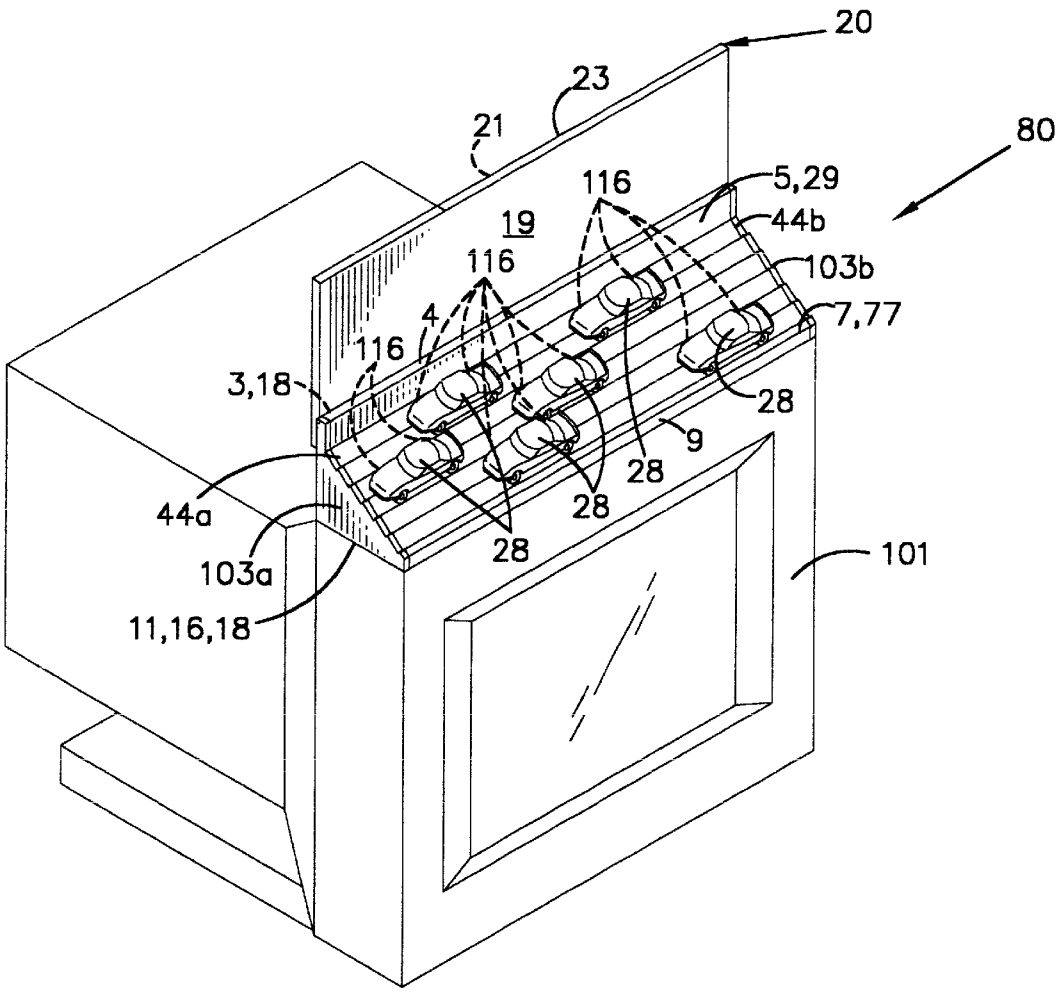
FIG. 25 is a perspective view of straightaway shelf unit attached to top of computer monitor.
Figure 28:
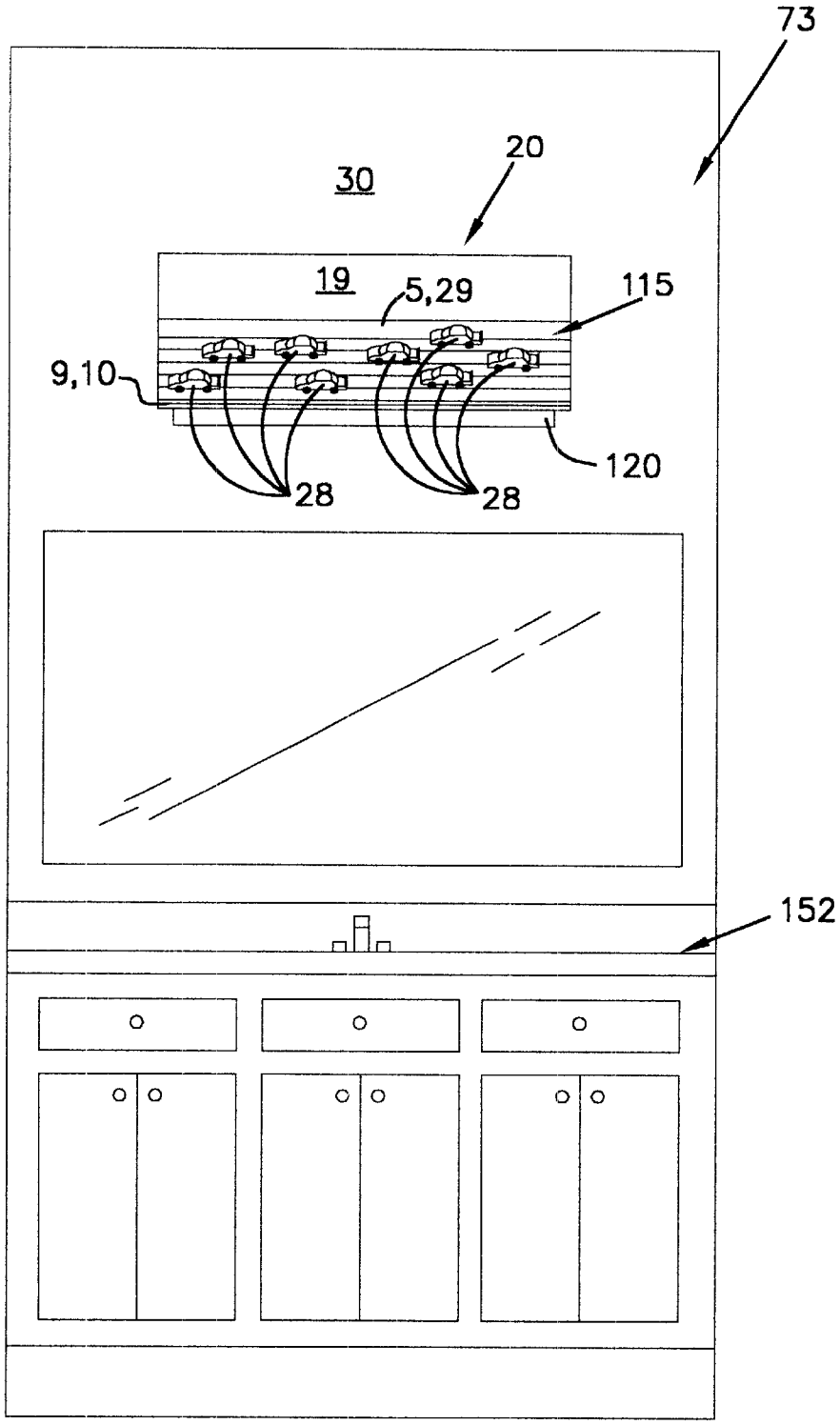
FIG. 28 is a elevation view of shelf modified with a standard light fixture mounted below it and installed over a bathroom vanity mirror and cabinets.

The display shelf unit 1 is assembled the same as previously described except the double sided adhesive tape 18 as shown in FIG. 7*b* is placed on the front graphic surface 19 at the bottom between the area indicated with the BETA symbol. The graphic board 20 is then attached to shelf mounting lip 3 of display shelf unit 1 top support channel 5. Yet another embodiment is used for mounting display shelf unit 1 without any mounting hardware, by cutting the display shelf unit 1 to fit any horizontal flat surface like the top of a computer monitor 101 and applying double sided tape 18 to the bottom outer surface 11 as illustrated in FIG. 25 or omit the double sided tape and set the bottom outer surface 11 inside a standard book shelf 151 on adjustable shelves 150 when no wall space is available as illustrated in FIG. 29. FIG. 28 illustrates a display shelf unit 1 installed on a mounting bracket 58 on a wall 30 over a standard bathroom vanity cabinet and mirror 152 modified to include a standard light fixture 120 attached to bottom outer surface 11.

Mounting Instructions

Figure 10:
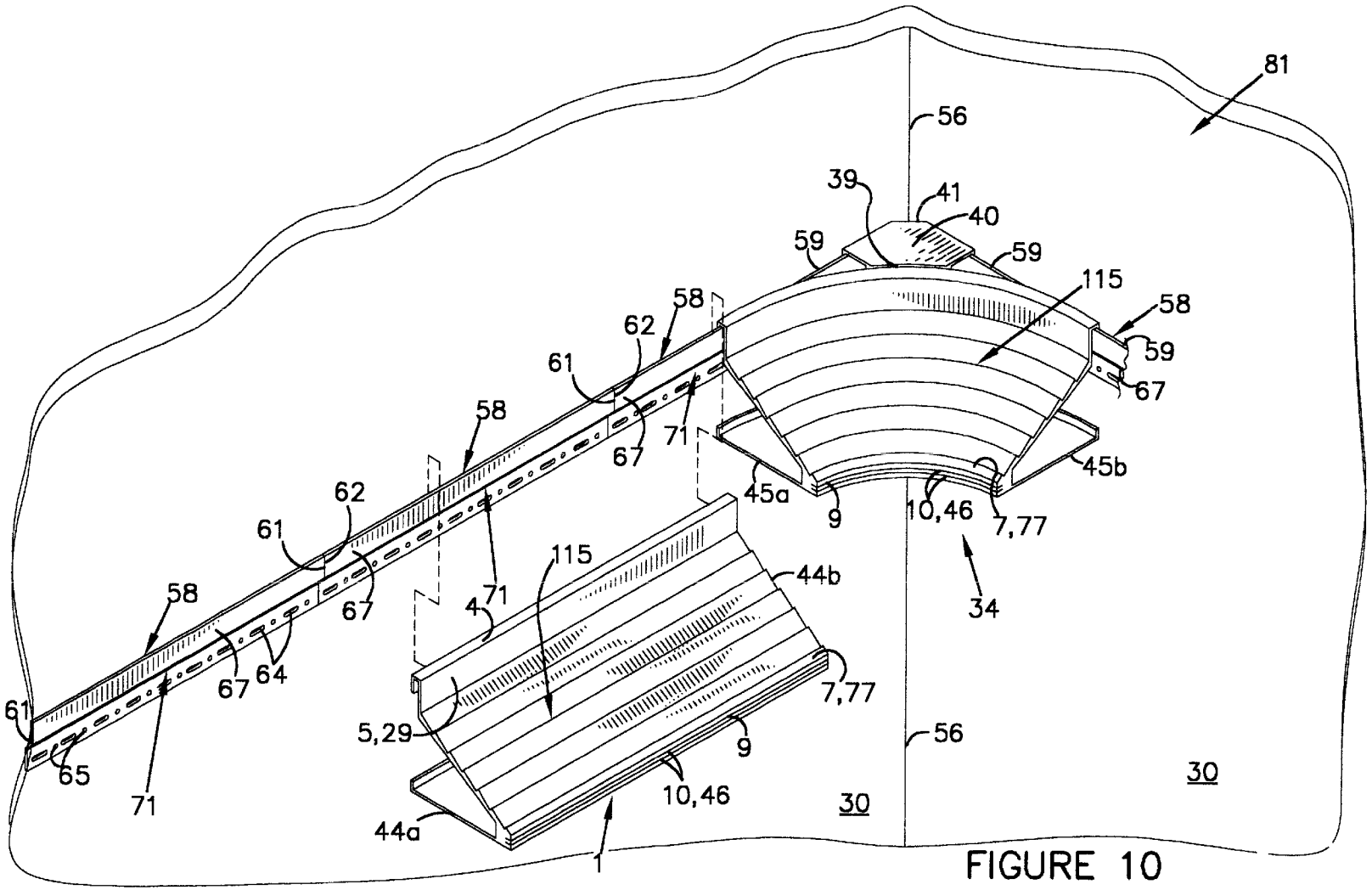
FIG. 10 Exploded perspective view after curved shelf unit is installed and prior to one straightaway shelf being installed.
Figure 11:
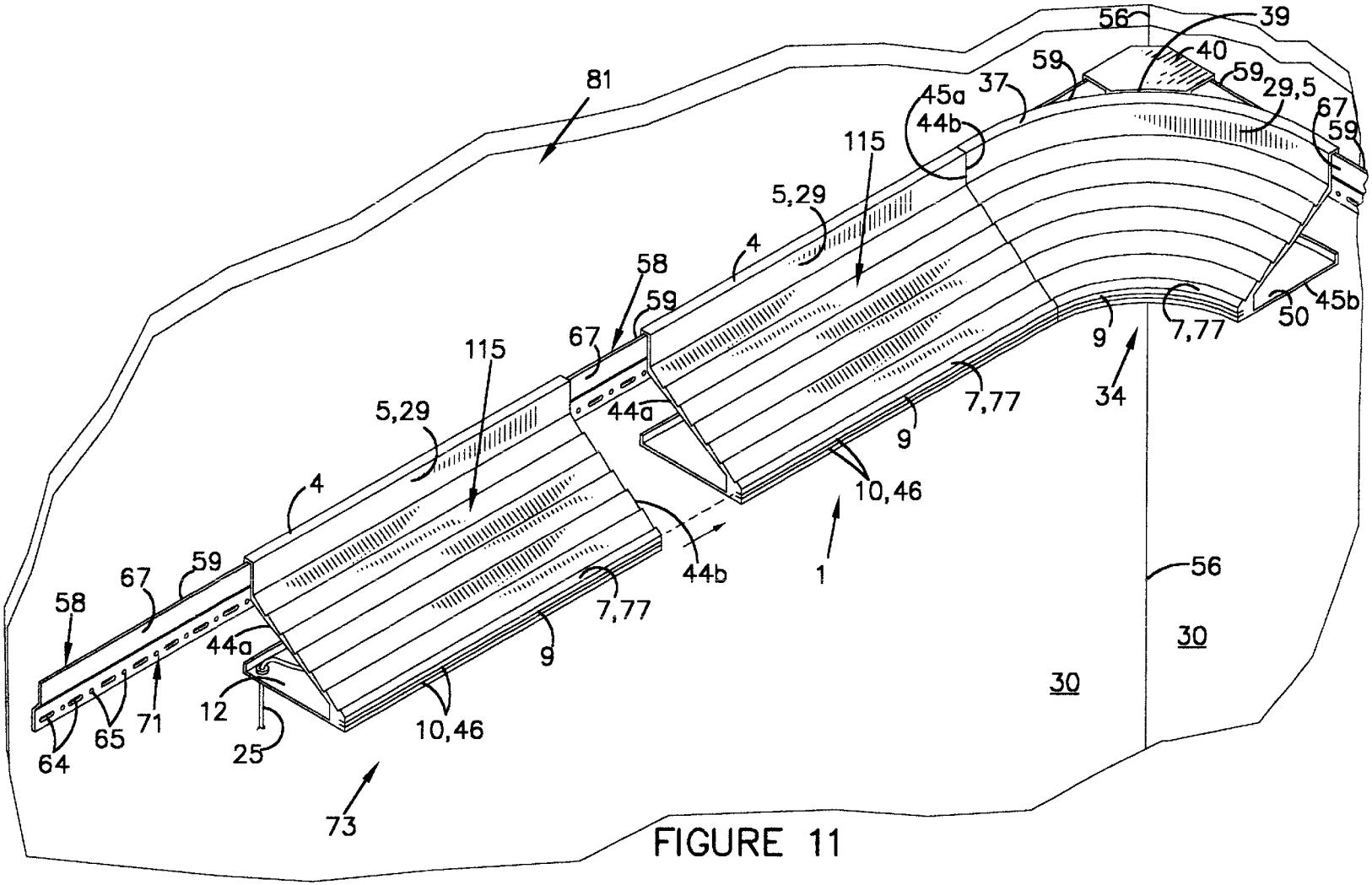
FIG. 11 Perspective view of one curved and one straightaway shelf unit installed and a second straightaway shelf unit installed sliding towards desired position next to first straightaway.

When mounting all components described above minimal effort and tools are required, a measuring tape, level, pencil and a screwdriver. The following installation specifications described are such that any one familiar in the art can understand. Refer to FIG. 4 as the first step is to determine the mounting height that is desired for displaying the model cars 28. This will be the location of the shelf bottom outer surface 11. Add desired mounting height to the distance represented with the letter C between the shelf bottom outer surface 11 and corner located at bottom of support channel front surface 5 that meets at the top shelf face surface 115. Place the mounting bracket 58 on structural wall 30 with the bottom end 60 on previously determined mounting height mentioned above and place a level on top of mounting bracket 58. Once bracket is leveled, mark a line on structural wall 30. If other units will be installed next to the first display shelf unit 1 continue to mark a level line on structural wall 30. The same is applied for installing curved shelf unit 34. Next locate and mark structural members 55 on leveled line previously marked on wall 30. Place mounting bracket on wall 30 with bottom end 60 on level line, then place mounting screws 33 in perforated holes 65 or slots 64 where the structural members 55 are marked. When including curved corner pieces in arrangement, all the corners should be installed first. After all mounting brackets 58 are in place and self adhesive graphics are installed on display shelf unit 1 simply hang the display shelf unit 1 onto mounting bracket 58 by hanging display shelf unit 1, by its shelf mounting lip 3 on top end 59 of the mounting bracket 58 as illustrated in FIGS. 9, 10, 11. Once display shelf unit 1 is hung, it can be slid horizontally into position as illustrated in FIG. 11. Place graphic board 20 in place and install clear channels 102 on each end 22*a* and 22*b* as previously described above illustrated in FIG. 12. Refer to FIG. 20 for covering exposed shelf ends when any partial display is erected. The end cover plates 103*a* and 103*b* are installed by inserting their three male prongs 118 into three female cylindrical holes 117 located on display shelf unit 1 ends 44*a* and 44*b* or curved shelf unit 34 ends 45*a* and 45*b*. The final step is to place the model cars 28 as desired onto track top shelf face surface 115 as illustrated in FIG. 1.

Electrical Lights and Accessories

Figure 19:
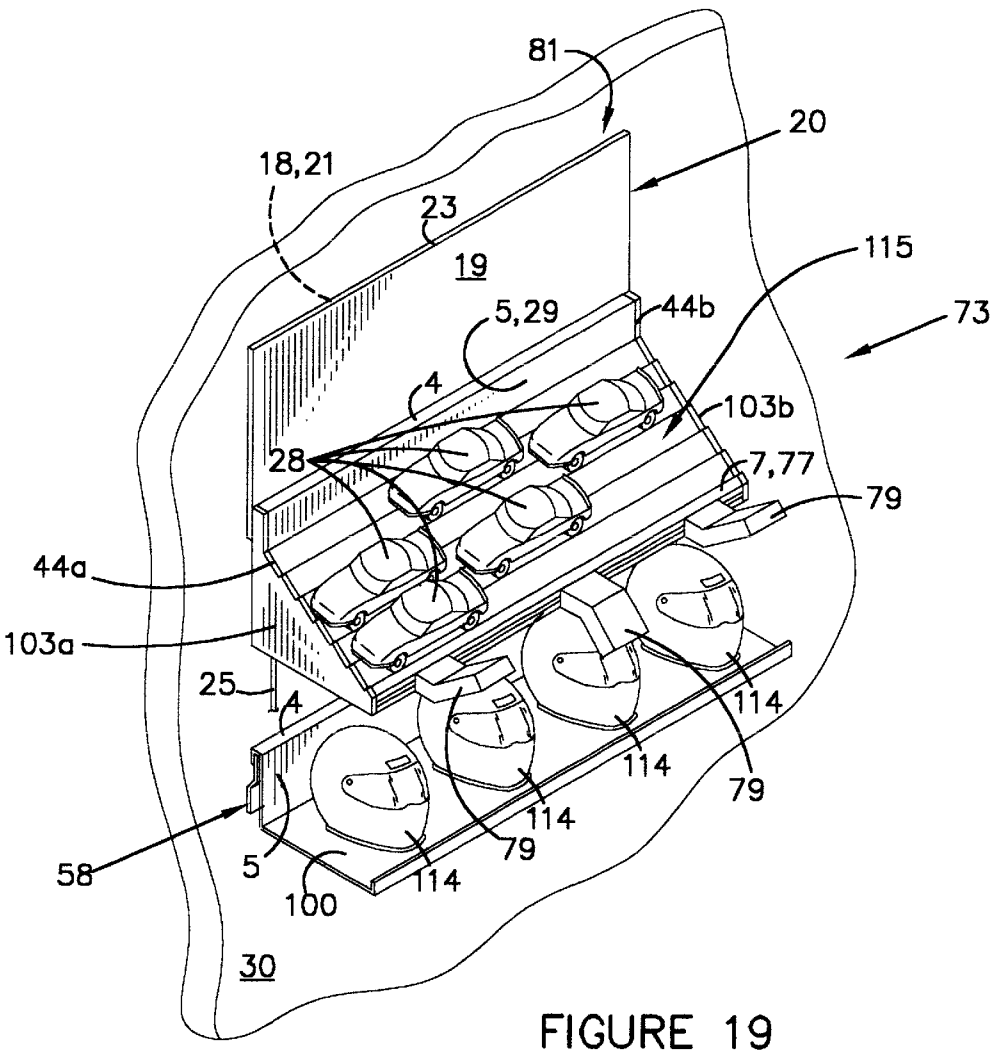
FIG. 19 is a perspective view of one straightaway section with second embodiment miscellaneous figurine display shelf unit installed below first display shelf unit mounted on wall.

Other accessories are available for enhancing the display shelf unit 1, once all shelves are in place with model cars 28 set on display shelf unit 1 as illustrated in FIG. 1. Refer to illustration in FIG. 16 a plug in type light fixture 79 that contains a clear lens 107 that distributes the light source towards any visible surface on the display shelf unit 1 from the observer's point of view. Each includes male electrically conductive plugs 108 for mating into shelf 1 electrical power receptacle 9 containing bus bars 10 and female slots 46 that are electrically connected to a light bulb inside light fixture 79. The refractor lens 107 can be removed to service lights as needed. Several lights 79 can be plugged in any location on electrical power receptacle bus bar 10 as desired. Refer to illustration in FIG. 17 a lighted sign 104 that also contains conductive plugs 108 and display lens 107. The sign 104 can also be placed any where on the track by means of electrical power receptacle bus bars 10. The sign is for any messages i.e. DO NOT TOUCH or any word or logo that can be displayed. It is recommended that at least one sign 104 or light 79 be placed between two joining display shelf unit 1 to electrically connect them together otherwise multiple power cords will be required. Furthermore either light 79 or sign 104 can incorporate an accessible fuse to protect bus bar 10 when multiple units are joined. The light fixture 79 can be installed upside down so that light can be provided beneath display shelf unit 1 for illuminating other objects that hang on wall 30 as illustrated in FIG. 19.

Description of Drag Racing Straight Shelf and Accessories

Figure 23:
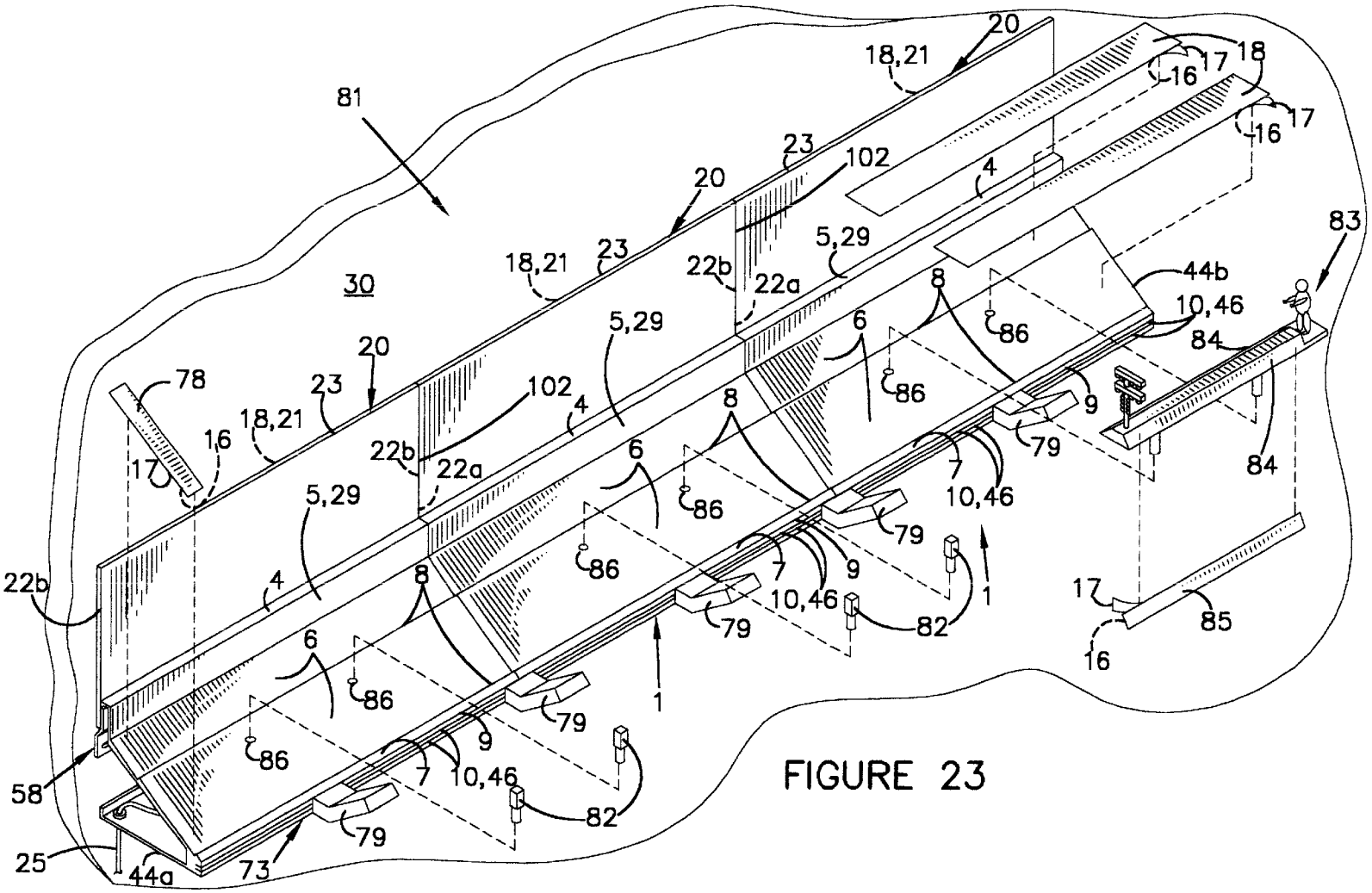
FIG. 23 is a exploded perspective view of second embodiment shelf and accessories for straightaway drag racing display.
Figure 24:
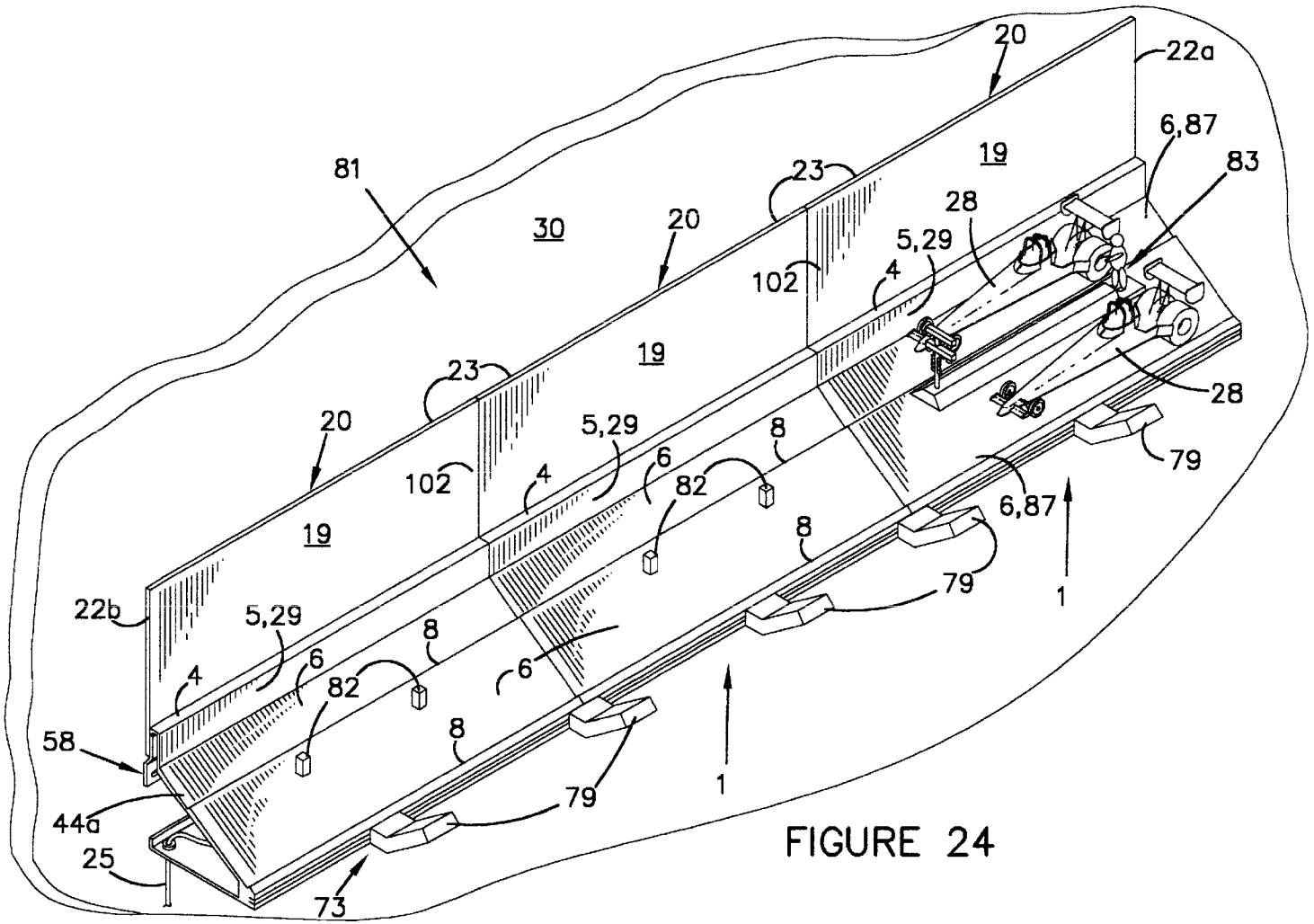
FIG. 24 is a perspective view of second embodiment shelf and accessories installed for Straightaway drag racing display.

Another embodiment of a straight display shelf unit 1 is illustrated in FIGS. 23 and 24. All parts and functions are identical to those as previously described for a display shelf unit 1 except, modified so that top shelf face surface 115 now contains two unevenly spaced sloped grooves 8 and two unevenly spaced sloped surfaces 6 to allow for only two racing lanes that represent a straight drag racing track. In the center of display shelf unit 1 a number of holes 86 are equally spaced for installing center race track lane figurine markers 82 or starting island 83. Like the primary display shelf unit 1 previously described several decals can be installed in addition to the track wall decal 29 to enhance the life-like appearance of the display shelf unit 1. A self adhesive decal 85 with adhesive surface 16 and adhesive protective strip 17 can be placed on either surface 84 of the starting island figurine 83 to display track logo and names. A pair of decals 87 can be installed on top shelf face surface 115 on each lane on the side of starting island 83 to represent a drag racing car burnout displaying tire rubber on track.

Description of Miscellaneous Display Shelf Unit

Yet another shelf embodiment 100 is illustrated in FIG. 19 that is shown mounted on wall 30 by means of mounting bracket 58 and mounted below previously described display shelf unit 1. This shelf 100 is used to display any miscellaneous collectable 114 like caps, model helmets, collectibles or figurines related to the model cars on display above. The shelf 100 is flat with a lip formed at one end when shelf is made at an angle. The lip at the end of the shelf 100 can be omitted when shelf is not at an angle.

Description of Shelf Unit without Grooves

Figure 30:
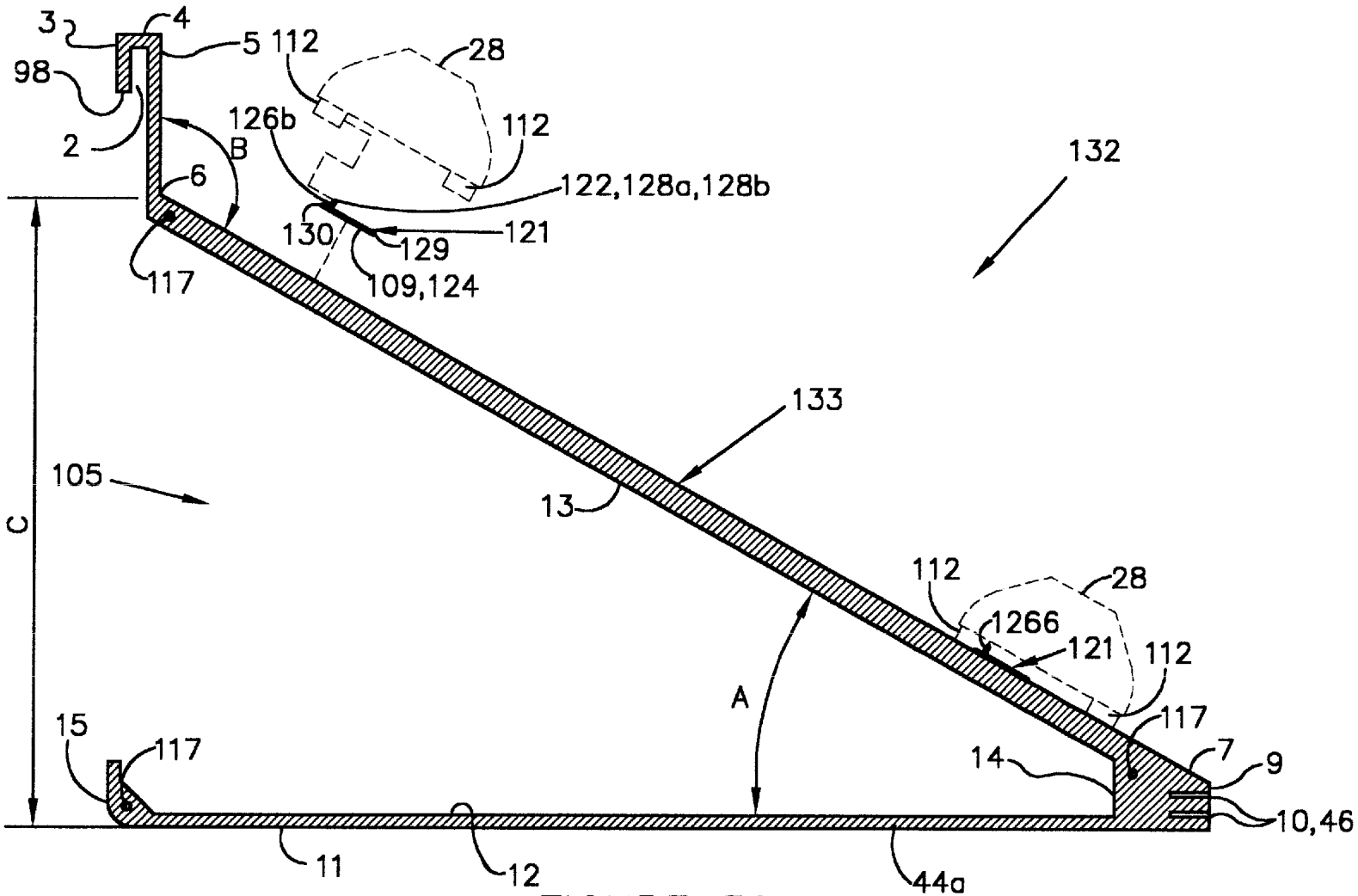
FIG. 30 is a schematic side view of a straightaway shelf unit of present invention with two cars being placed onto track and with top surface grooves omitted. The mounting bracket, graphic board and power cord are not shown.
Figure 31:
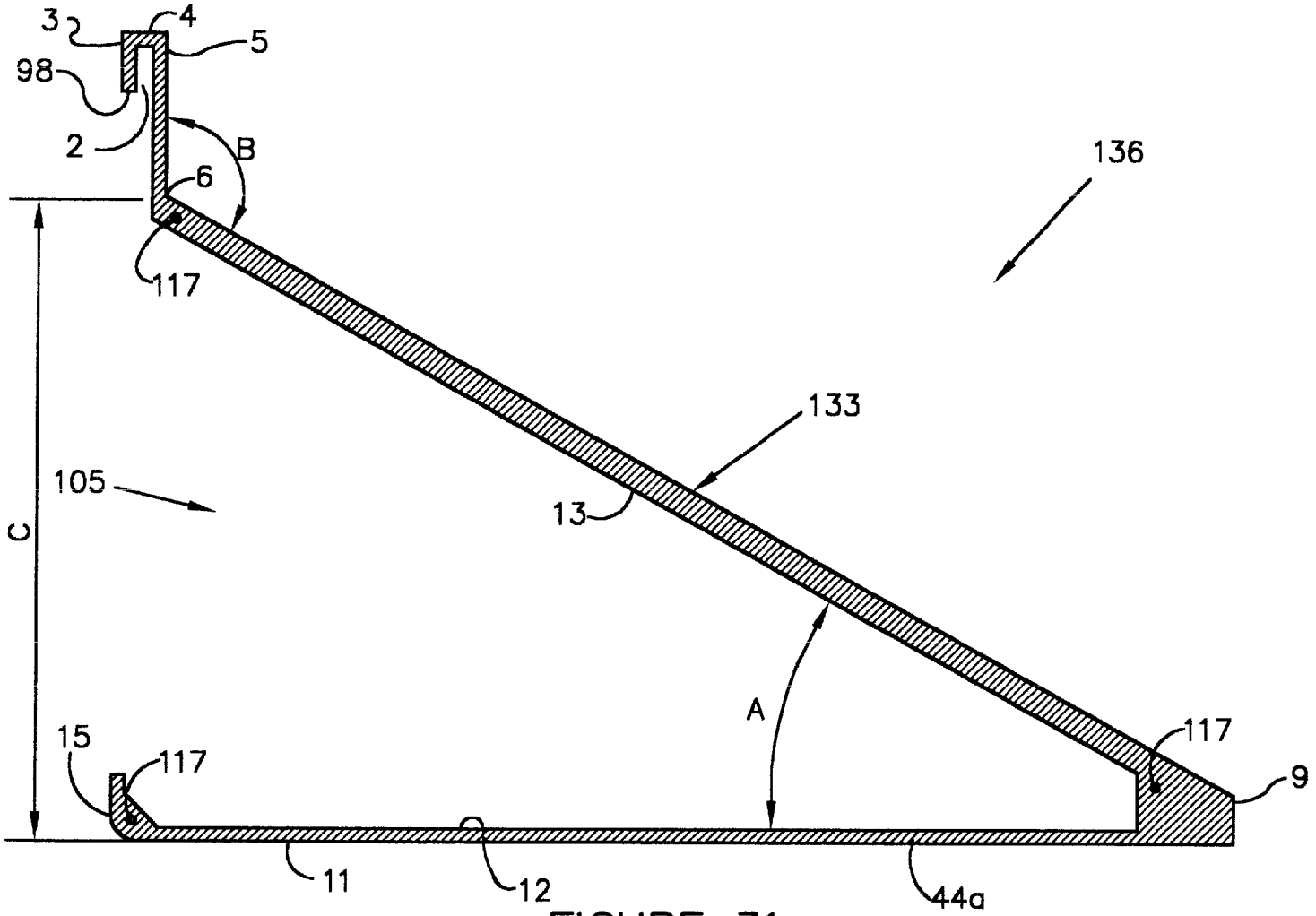
FIG. 31 is a schematic side view of a straightaway shelf unit of present invention with top surface grooves and electrical power receptacle omitted. The mounting bracket and graphic board are not shown.
Figure 33:
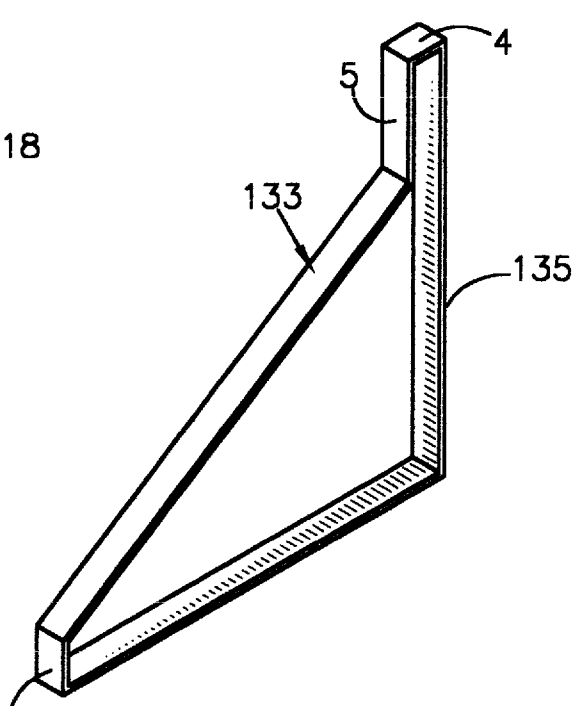
FIG. 33 is a perspective view of a shelf cutting tool with out top surface grooves.
Figure 32B:
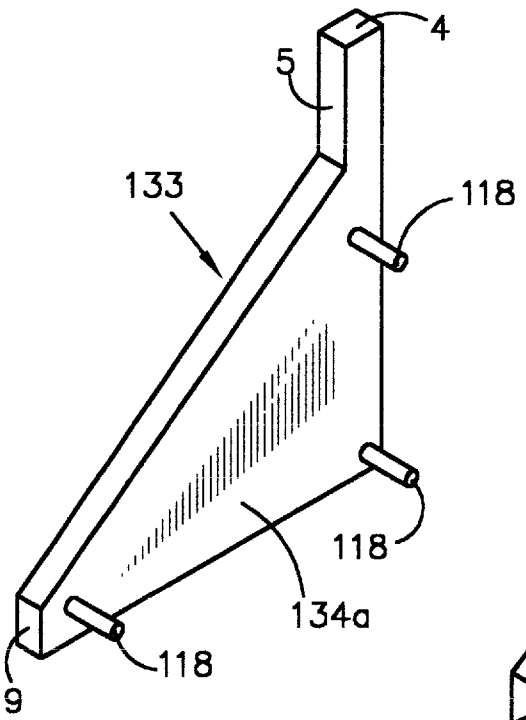
FIG. 32*b* is a perspective view of a shelf left end cover plate with out top surface grooves.
Figure 32A:
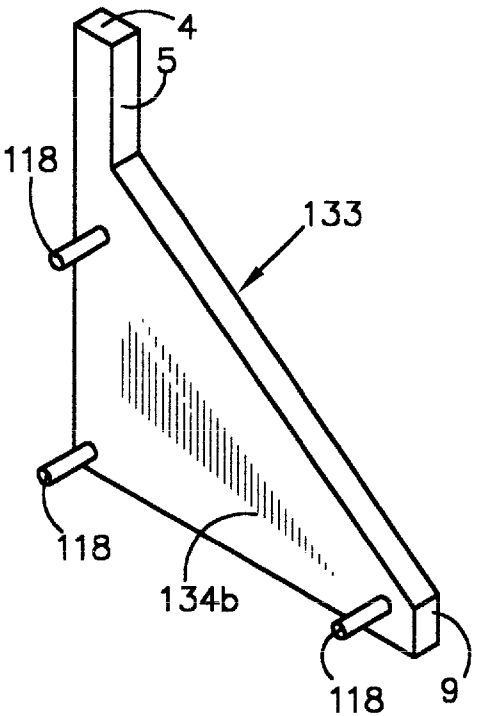
FIG. 32*a* is a perspective view of a shelf right end cover plate with out top surface grooves.

Still yet two other shelf unit embodiments 132 and 136 are illustrated in FIGS. 30 and 31. These two shelf embodiments are functional and combine all the same parts identical to shelf units 1,34, 73 and 80 previously described except that the individual sloped surfaces 6, 7 and grooves 8 are omitted on top shelf face surface 115. The new top shelf face surface is represented with the numeral 133. The difference between the two display shelf units 132 and 136 are that display shelf unit 136 does not contain the electrical power bus bars 10 and space 46. Both display shelf units 132 and 136 still allow for installation of the end plates 134*a* and 134*b* as illustrated in FIGS. 32*a* and 32*b* and cutting guide tool 135 illustrated in FIG. 33. The difference between the left end cover plate 134*a,* right end cover plate 134*b* and cutting guide tool 135 to previously described end cover plates 103*a,* 103*b* and cutting tool 119 are the removal of slopes surfaces 6, 7 and grooves 8 to form a new flat top surface 133.

Description of Shelf Unit without Grooves and Electrical Power Receptacle

Figure 36:
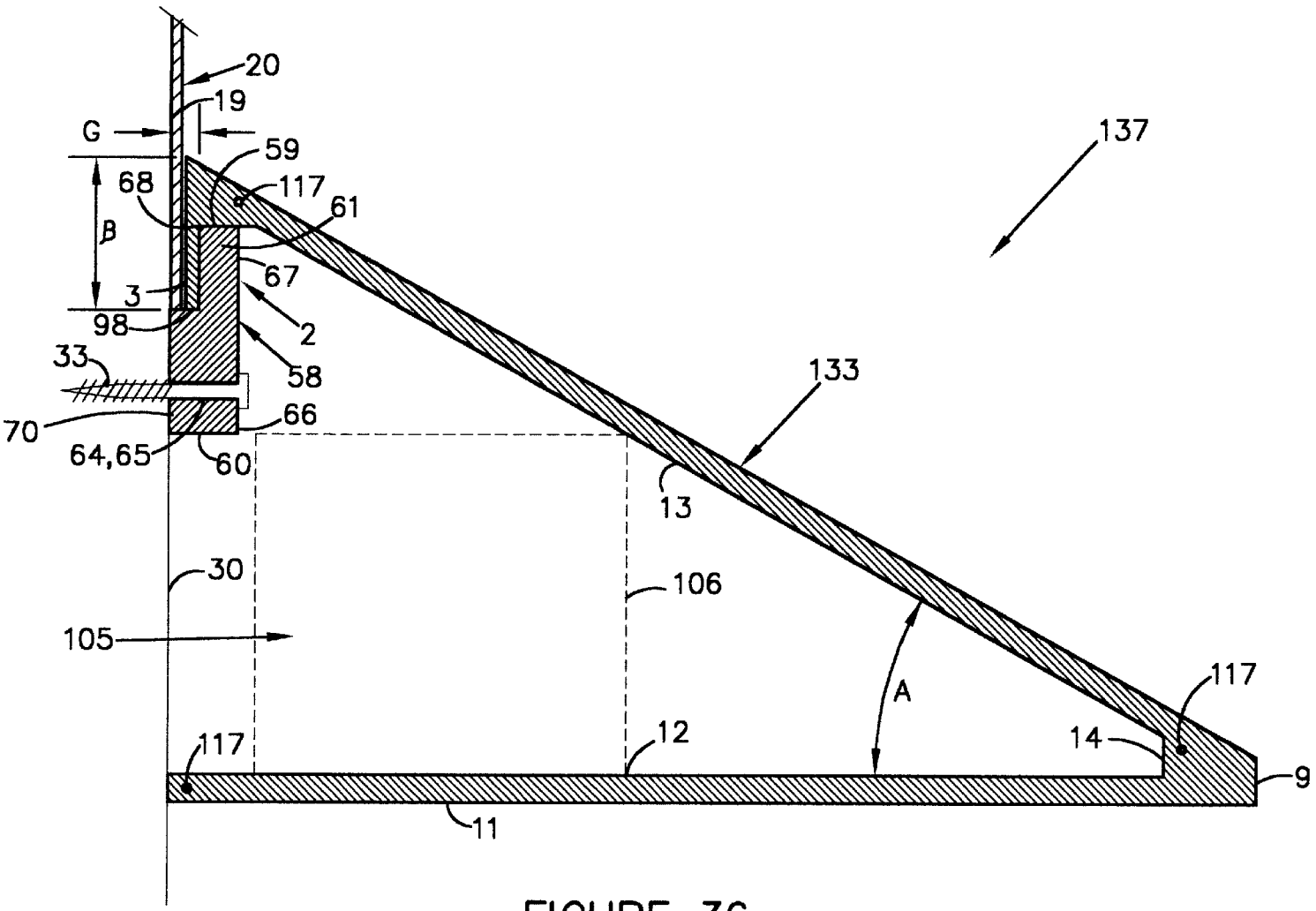
FIG. 36 is a schematic side view of a straightaway shelf unit of present invention with top surface grooves, electrical power receptacle and mounting channel omitted. Shown mounted onto mounting bracket with graphic board.
Figure 37:
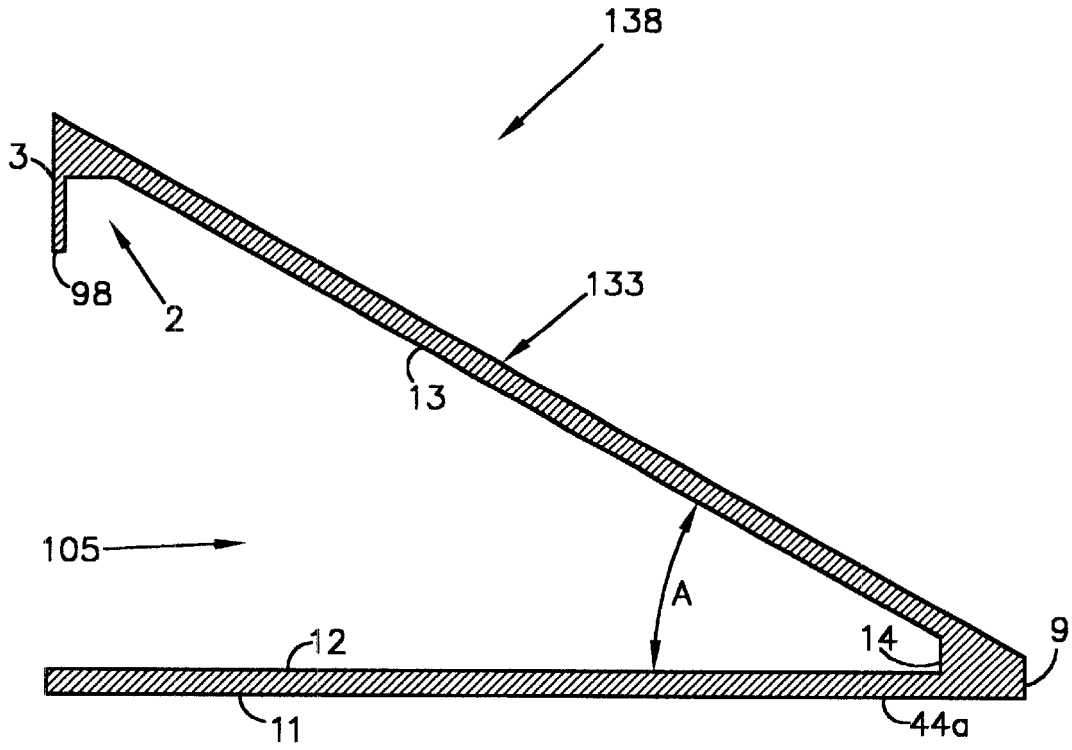
FIG. 37 is a schematic side view of a straightaway shelf unit of present invention with top surface grooves, electrical power receptacle bus bars, end cover plate holes and mounting channel omitted. The mounting bracket, cars and graphic board are not shown.
Figures 41A, 41B, 42, 43:
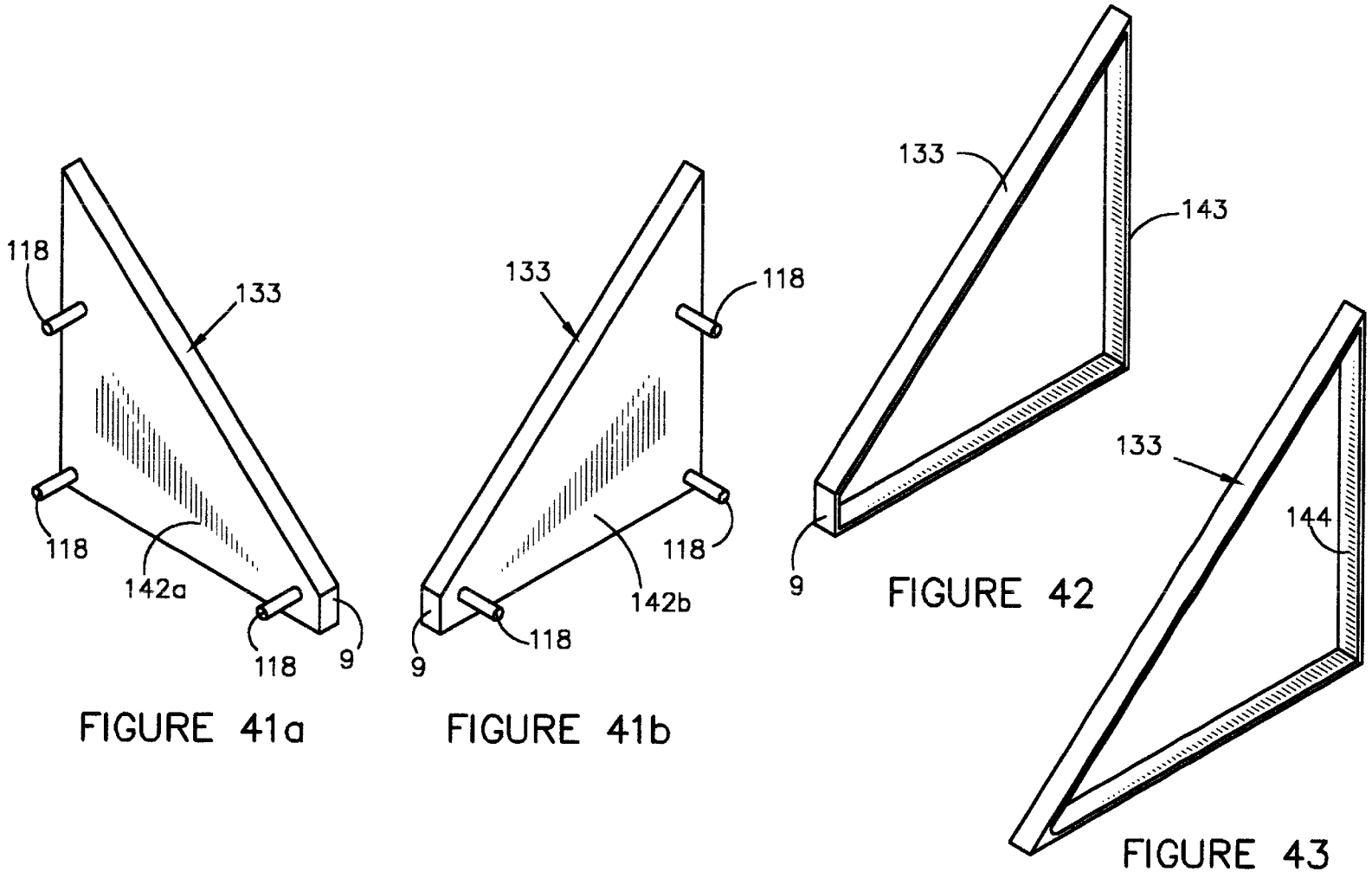
FIG. 41*a* is a perspective view of a shelf right end cover plate with out top surface grooves and channel.
FIG. 41*b* is a perspective view of a shelf left end cover plate with out top surface grooves and channel.
FIG. 42 is a perspective view of a shelf cutting guide tool with out top surface grooves and channel.
FIG. 43 is a perspective view of a shelf cutting guide tool with out top surface grooves, receptacle surface and channel.

Other display shelf embodiments 137 and 138 are illustrated in FIGS. 36 and 37. These two shelf embodiments are functional and combine all the same parts identical to display shelf embodiments 132 and 136 previously described except that the top mounting bracket channel parts 4, 5 rear surface 15 and electrical power receptacle parts 10 and 46 are omitted. The mounting channel parts 4 and 5 are replaced with a mounting lip 3 that projects downward towards display shelf units 137 or 138 bottom surface 11. The difference between the two display shelf units 137 and 138 are that shelf embodiment 138 does not contain the three end cover holes 117. Embodiment 137 still allows for installation of the end plates 142*a* and 142*b* as illustrated in FIGS. 41*a* and 41*b* and cutting guide tool 143 illustrated in FIG. 42. The difference between the right end cover plate 142*a,* left end cover plate 142*b* and cutting guide tool 143 to previously described end cover plates 134*a,* 134*b* and cutting tool 135 are the removal of surfaces 4 and 5 from top of surface 133.

Figure 38:
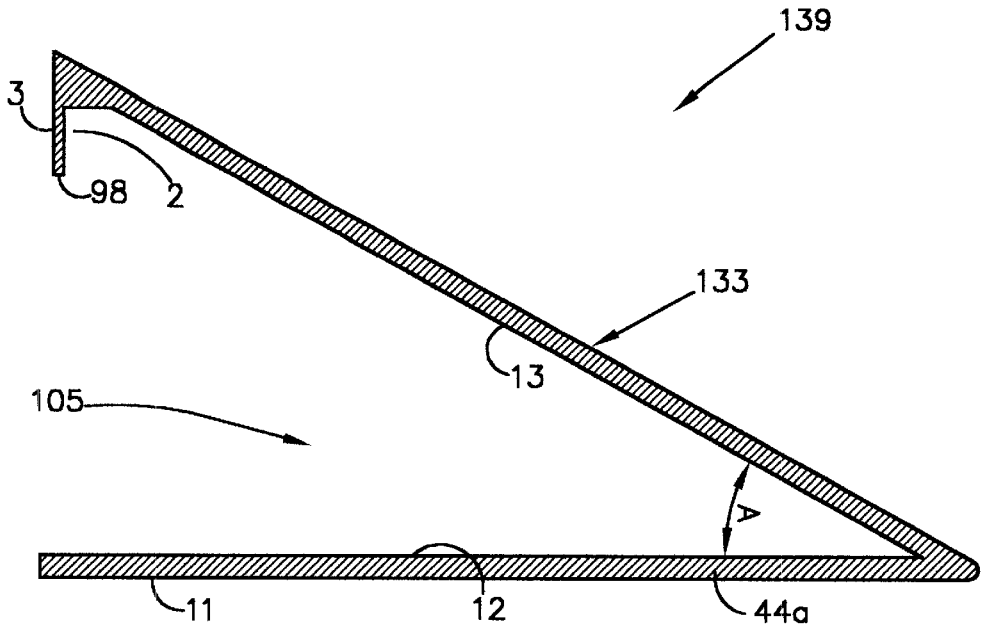
FIG. 38 is a schematic side view of a straightaway shelf unit of present invention with top surface grooves, electrical power receptacle bus bars/front surface, end cover plate holes and mounting channel omitted. The mounting bracket, cars and graphic board are not shown.
Figure 39:
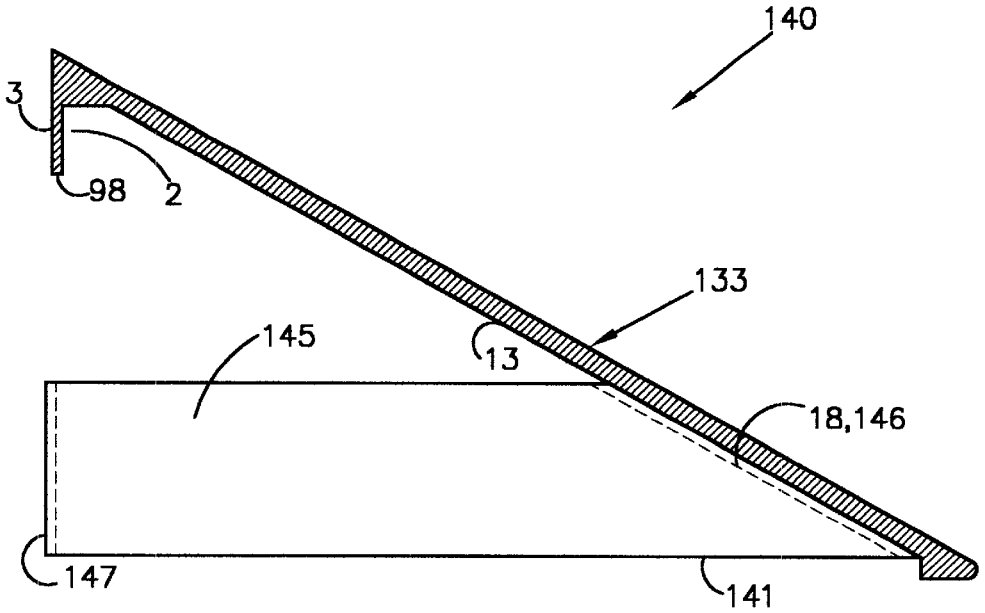
FIG. 39 is a schematic side view of a straightaway shelf unit of present invention with top surface grooves, electrical power receptacle bus bars/front surface, end cover plate holes, bottom storage shelf and mounting channel omitted. The mounting bracket, cars and graphic board are not shown.
Figure 40A:
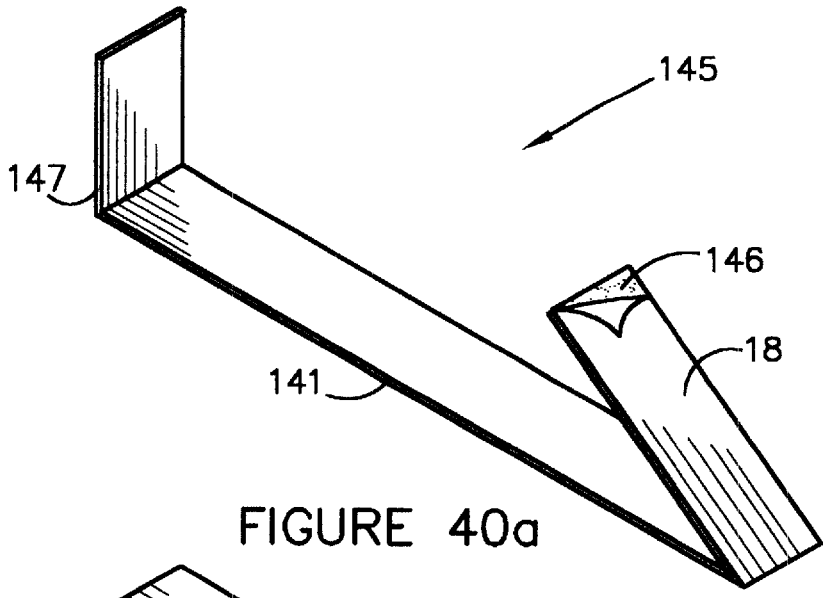
FIG. 40 is a perspective view of shelf support brace.
Figure 40B:
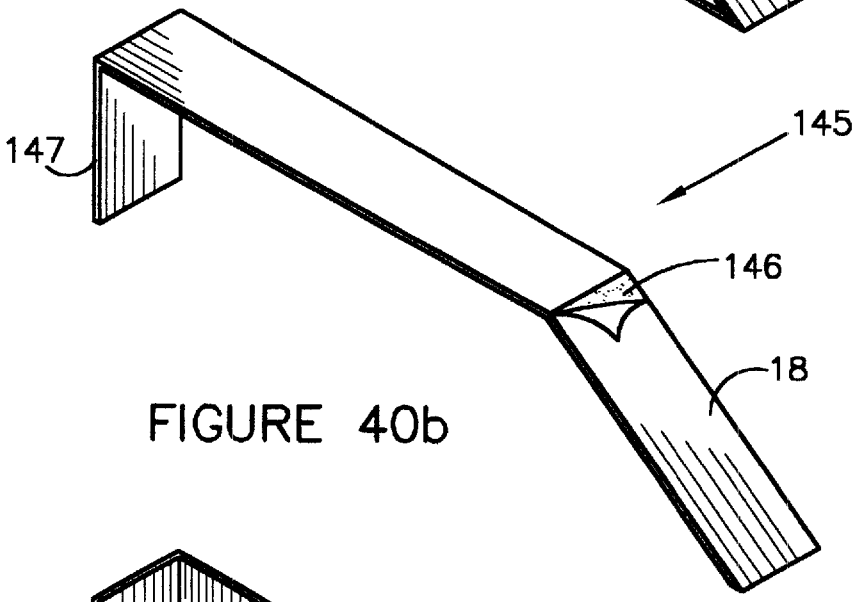
Figure 40C:
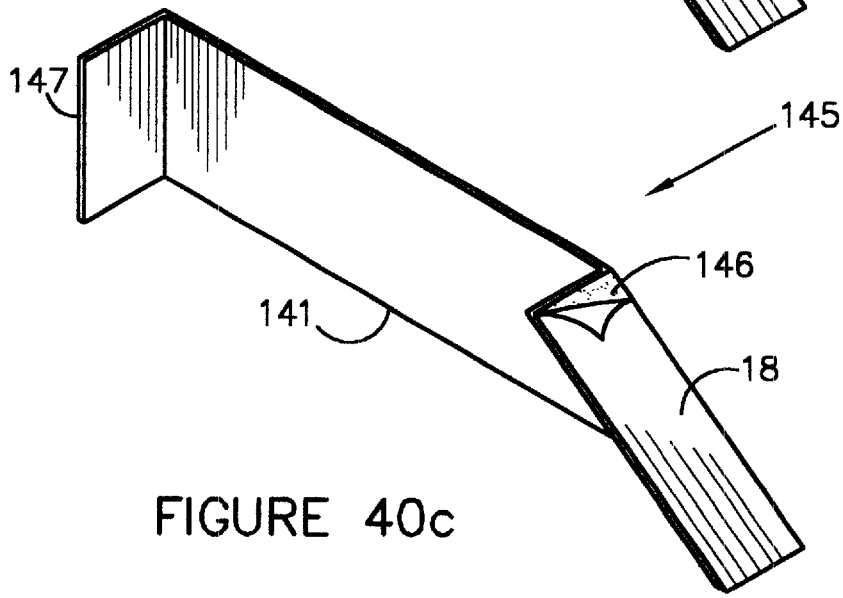
Figure 47:
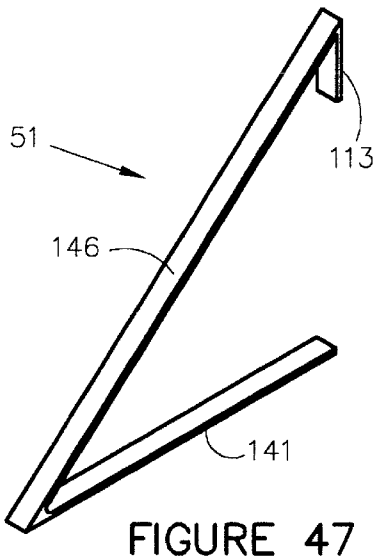
FIG. 47 is a perspective view of the shelf mounting brace.
Figure 46:
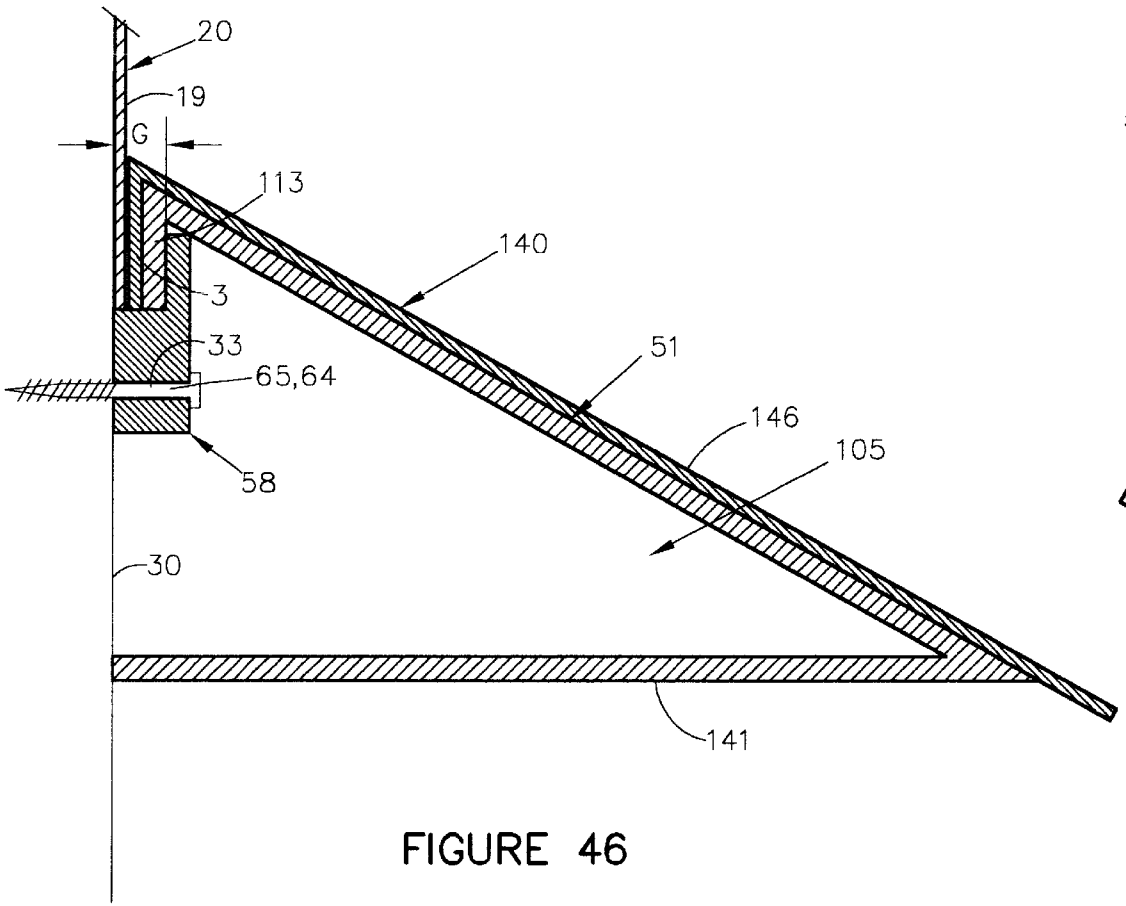
FIG. 46 is a schematic view of a shelf unit, mounting bracket, shelf brace, wooden shelf.

Another Description of Shelf Unit without Grooves, Top Wall Channel and Electrical Power Receptacle Other display shelf embodiments 139 and 140 are illustrated in FIGS. 38 and 39. These two shelf embodiments are functional and combine all the same parts identical to display shelf units 137 and 138 previously described except that surface 9, end cover holes 117 are omitted. The difference between the two display shelf units 139 and 140 are that shelf embodiment 140 does not contain the bottom surface parts 11, 12, 14 and requires a brace 145 to prevent top shelf face surface 133 from flexing downwards as illustrated in FIG. 40. The brace 145 contains a top surface 146 at same angle as top shelf face surface 133 and attaches to bottom surface 13 of top surface 133 as required with double sided tape 18. The shelf brace rear surface 147 rest against wall 30 to prevent shelf top shelf face surface 133 from flexing downward as illustrated in FIG. 39. Neither embodiment 139 or 140 allows for installation of the end cover plates 142*a* and 142*b*. Only embodiment 139 still requires cutting guide tool 144 illustrated in FIG. 43. The difference between the cutting guide tool 144 to previously described cutting tool 143 are the removal of surfaces 9 and 14 from top of surface 133. Now refer to FIG. 46. Which shows a schematic of a different embodiment of a support brace that is functionally the same as brace 145 except that new shelf brace 51 as illustrated in FIG. 47 contains a lip 113, bottom 141 and a brace top surface 146. Once mounting bracket 58 is attached to a wall 30 the shelf brace 51 brace lip 113 is hung onto mounting bracket 58 in receptacle area G where the display shelf 140 and its shelf mounting lip 3 engage with said shelf brace 51.

Description of Types of Wheel Chucks

Figure 44:
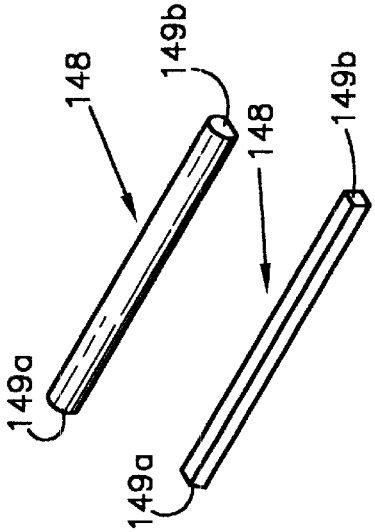
FIG. 44 is a perspective view of a four sided wheel chuck bar.
Figure 17:
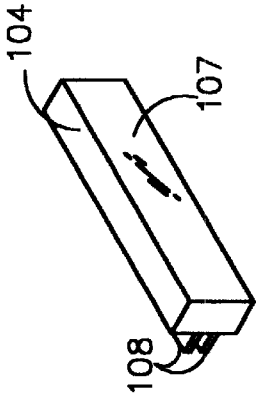
FIG. 17 is a perspective view of typical miscellaneous light sign.
Figure 16:
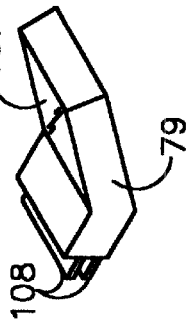
FIG. 16 is a perspective view of typical display light.
Figure 34:
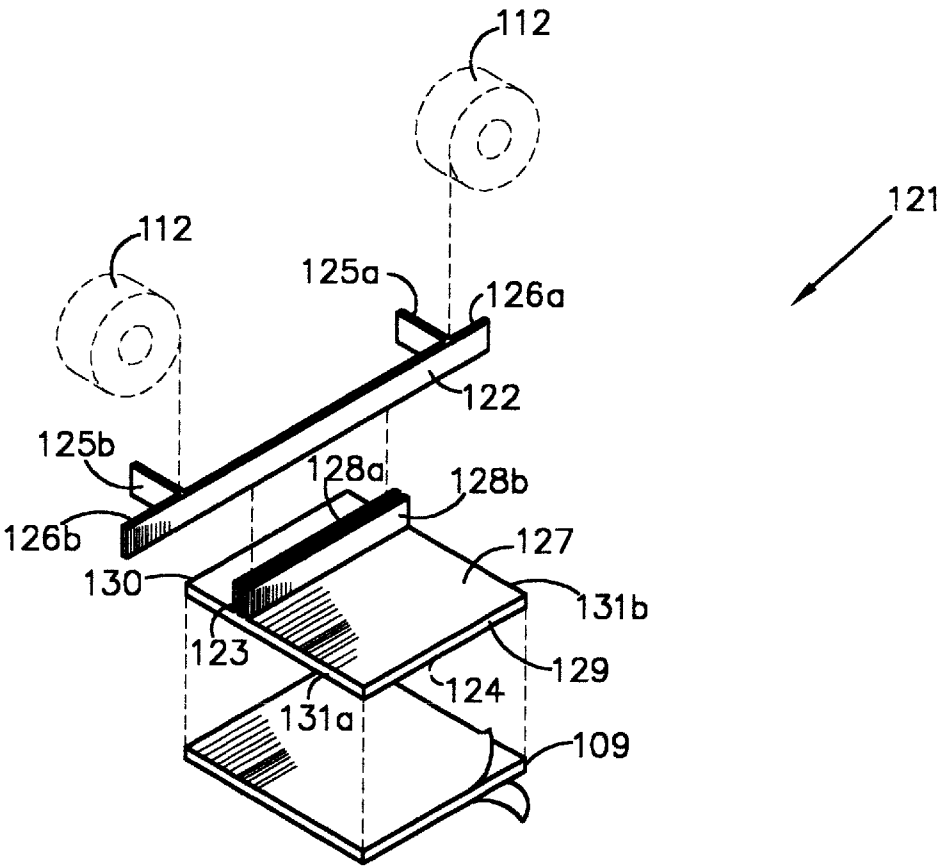
FIG. 34 is a perspective view of adjustable wheel chuck.
Figure 35B:
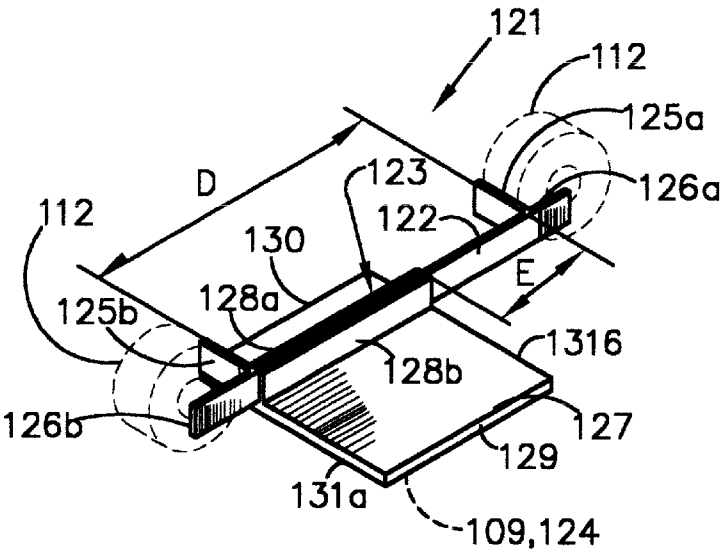
FIG. 35*b* is a perspective view of adjustable wheel chuck in its right side furthermost position.
Figure 35A:
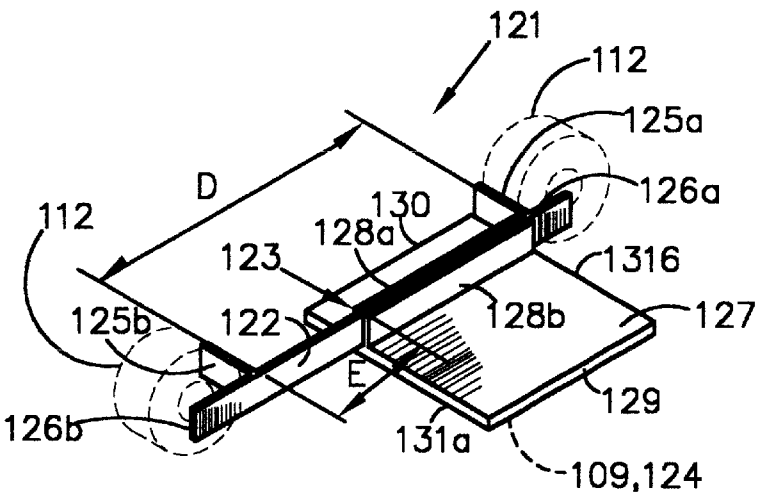
FIG. 35*a* is a perspective view of adjustable wheel chuck in its left side furthermost position.

The preferred method of attaching model cars 28 to top shelf face surface 133 on shelves 132, 136, 137, 138, 139 and 140 is by means of an adjustable wheel chuck 121 illustrated in FIG. 34. The adjustable wheel chuck contains a slide bar 122 that snaps inside base 127 in groove 123 that is made up of a back wall 128*a* and front wall 128*b*. The slide bar 122 contains wheel horizontal stops 125*a* and 125*b*, wheel vertical stops 126*a* and 126*b*. The top base 127 has a front end 129, rear end 130, right end 131*b*, left end 131*a* and bottom 124. FIGS. 35*a* and 35*b* shows the distance between ends 131*a* and 131*b* is less than the distance represented by the letter D and the remaining distance represented by the letter E is the total allowable adjustable traveling distance of the slide bar 122. The adjustable wheel chuck 121 is shown attached on top of shelf face surface 133 by means of double sided tape 109 such that front end 129 and top of base 127 are beneath the model car 28 facing downward towards the bottom of top surface 133. The base 127 can attach to top surface by any means necessary rather it be glue, rivet, magnet or screws. Any two model car wheels 112 not visible from observation point can be placed inside the wheel stops 125*a*, 125*b*, 126*a* and 126*b* as illustrated in FIGS. 30,34,35*a* and 35*b*. The adjustable wheel chuck 121 can be placed anywhere on top shelf face surface 133 at various angles. Once in place, the model cars 28 can be adjusted in either direction within remaining space distance represented by the letter E. Yet another wheel chuck 148 is illustrated in FIG. 44 shown containing four sides, double sided tape 109 and ends 149*a* and 149*b*. The wheel chuck can also be attached onto top surface of shelf by means described above for adjustable wheel chuck 121 and be cylindrical in shape instead of four sides.

As to a further discussion of the manner of the usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, color, weight, materials, shape, form, function and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

I claim:

1. A display unit for model vehicles, where the model vehicles have at least one wheel, said display unit comprising at least one mounting bracket, a shelf, removably positionable and supportable on said at least one mounting bracket, said shelf having a display portion for displaying a model vehicle, said display portion forming an acute angle with a horizontal surface when said shelf is mounted on said at least one mounting bracket, and a means for mounting a model vehicle on said display portion of said shelf, and where said means for mounting a model vehicle is a plurality of offset parallel grooves in said display portion, so that in cross-section, said display portion is sawtoothed shaped.

2. A display unit for model vehicles, where the model vehicles have at least one wheel, said display unit comprising at least one mounting bracket, a shelf, removably positionable and supportable on said at least one mounting bracket, said shelf having a display portion for displaying a model vehicle, said display portion forming an acute angle with a horizontal surface when said shelf is mounted on said at least one mounting bracket, and a means for mounting a model vehicle on said display portion of said shelf, and where said means for mounting a model vehicle is removably attachable to said display portion of said shelf.

3. A display unit for model vehicles according to claim 2 farther having a graphics board attachable to said shelf.

4. A display unit for model vehicles according to claim 2 where said removably attachable means for mounting a model vehicle is a wheel chuck.

5. A display unit for model vehicles according to claim 4 where said wheel chuck has a base removably attachable to said display portion of said shelf and a bar projecting from said base, said bar engagable with a portion of a model vehicle near the at least one wheel of the model vehicle.

6. A display unit for model vehicles according to claim 5 where said bar is engagable with a wheel of the model vehicle.

7. A display unit for model vehicles according to claim 5 where said wheel chuck further has a magnet for removable attachment to said display portion of said shelf.

8. A display unit for model vehicles, where the model vehicles have at least one wheel, said display unit comprising at least one mounting bracket, a shelf, removably positionable and supportable on said at least one mounting bracket, said shelf having a display portion for displaying a model vehicle, said display portion forming an acute angle with a horizontal surface when said shelf is mounted on said at least one mounting bracket, and a means for mounting a model vehicle on said display portion of said shelf, and further having an electrical power receptacle positioned on said shelf.

9. A display unit for model vehicles, where the model vehicles have at least one wheel, the said display unit comprising a free-standing shelf having a base and a shelf joined so that when said base is positioned on a horizontal surface, said shelf forms and acute angle with the horizontal surface, said shelf having a display portion for model vehicles, and said display unit further having a means for mounting a model vehicle on said display portion, and where said means for mounting a model vehicle is a plurality of offset parallel grooves in said display portion, so that in cross-section, said display portion is sawtoothed shaped.

10. A display unit for model vehicles, where the model vehicles have at least one wheel, the said display unit comprising a free-standing shelf having a base and a shelf joined so that when said base is positioned on a horizontal surface, said shelf forms and acute angle with the horizontal surface, said shelf having a display portion for model vehicles, and said display unit further having a means for mounting a model vehicle on said display portion, and where said means for mounting a model vehicle is removably attachable to said display portion of said shelf.

11. A display unit for model vehicles according to claim 10 where said removably attachable means for mounting a model vehicle is a wheel chuck.

12. A display unit for model vehicles according to claim 11 where said wheel chuck has a base removably attachable to said display portion of said shelf and a bar projecting from said base, said bar engagable with a portion of a model vehicle near the at least one wheel of the model vehicle.

13. A display unit for model vehicles according to claim 12 where said bar is engagable with a wheel of the model vehicle.

14. A display unit for model vehicles according to claim 12 where said wheel chuck further has a magnet for removable attachment to said display portion of said shelf.

15. A display unit for model vehicles, the display unit comprising a shelf unit, said shelf unit having at least one mounting bracket and a shelf positionable on said at least one mounting bracket, said shelf having a display portion, said display portion, when said shelf is mounted on said at least one mounting bracket, forming a substantially acute angle with a horizontal surface, said shelf unit further having a wall mount attachment means to attach said shelf unit to a non-horizontal wall, and where said shelf has a top face and a bottom face, said display portion being located on said top face, said shelf further having a lip, said lip projecting away from said bottom surface, and where said wall mount attachment means comprises a bracket attachable to said non-horizontal wall, said bracket, when attached to said non-horizontal wall, forms an upwardly facing recess between said bracket and said wall, whereby said lip of said shelf is engagable in said recess to mount said shelf unit to said non-horizontal wall.

16. A display unit for model vehicles according to claim 15 further having a means for mounting a model vehicle to said display portion of said shelf.

17. A display unit for model vehicles according to claim 16 where said means for mounting a model vehicle is removably attachable to said display portion of said shelf.

18. A display unit for model vehicles according to claim 15 further having a graphics board attachable to said wall mount attachment means.

* * * * *